US009308756B2

(12) United States Patent
Matsumoto et al.

(10) Patent No.: US 9,308,756 B2
(45) Date of Patent: Apr. 12, 2016

(54) IMAGE FORMING APPARATUS AND METHOD OF SETTING PRINT MEDIA

(71) Applicants: Kazuyoshi Matsumoto, Tokyo (JP); Makoto Kikura, Kanagawa (JP); Kazuyoshi Kondo, Tokyo (JP); Yuuzoh Obata, Tokyo (JP); Norikazu Yanase, Kanagawa (JP); Yoshinori Uchino, Kanagawa (JP); Gaku Hosono, Kanagawa (JP); Tohru Watanabe, Kanagawa (JP); Toshihisa Nakamura, Tokyo (JP); Tadashi Okano, Kanagawa (JP); Naoki Saitoh, Kanagawa (JP)

(72) Inventors: Kazuyoshi Matsumoto, Tokyo (JP); Makoto Kikura, Kanagawa (JP); Kazuyoshi Kondo, Tokyo (JP); Yuuzoh Obata, Tokyo (JP); Norikazu Yanase, Kanagawa (JP); Yoshinori Uchino, Kanagawa (JP); Gaku Hosono, Kanagawa (JP); Tohru Watanabe, Kanagawa (JP); Toshihisa Nakamura, Tokyo (JP); Tadashi Okano, Kanagawa (JP); Naoki Saitoh, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 50 days.

(21) Appl. No.: 14/044,071

(22) Filed: Oct. 2, 2013

(65) Prior Publication Data

US 2014/0099150 A1 Apr. 10, 2014

(30) Foreign Application Priority Data

Oct. 6, 2012 (JP) ..... 2012-223716
Jun. 15, 2013 (JP) ..... 2013-126189

(51) Int. Cl.
*B41J 13/08* (2006.01)
*G03G 21/16* (2006.01)

(52) U.S. Cl.
CPC ..... *B41J 13/08* (2013.01); *G03G 21/1623* (2013.01); *G03G 21/1695* (2013.01); *G03G 2221/1684* (2013.01)

(58) Field of Classification Search
CPC ..... B41J 13/08; B41J 13/00; B41J 11/007; G03G 21/1623; G03G 21/1695; G03G 2221/1684
USPC ..... 400/619
See application file for complete search history.

(56) References Cited

U.S. PATENT DOCUMENTS 5,729,785 A * 3/1998 Sakaizawa et al. ..... 399/2
6,089,487 A * 7/2000 Imai et al. ..... 242/348.4
6,244,530 B1 * 6/2001 Imai et al. ..... 242/160.4
8,292,526 B2 * 10/2012 Sakai ..... 400/621

(Continued)

FOREIGN PATENT DOCUMENTS

CN 1269311 10/2000
CN 102234039 11/2011

(Continued)

OTHER PUBLICATIONS

U.S. Appl. No. 13/950,473, filed Jul. 25, 2013.

(Continued)

*Primary Examiner* — David Banh
(74) *Attorney, Agent, or Firm* — Cooper & Dunham LLP

(57) ABSTRACT

An image forming apparatus includes an apparatus body, a sheet feeder to load a roll body including a recording medium wound around, an image forming unit to form an image on the recording medium, and a conveyance unit including a conveyance belt to convey the recording medium drawn out from the roll body so as to oppose the recording medium to the image forming unit. The sheet feeder and the conveyance unit are integrated as a sheet feed conveyance unit. The sheet feed conveyance unit is configured to load the roll body in at least the sheet feeder and be drawable from the apparatus body to a position at which the conveyance belt is visible.

18 Claims, 28 Drawing Sheets

(56) References Cited

U.S. PATENT DOCUMENTS

| | | | | |
|---|---|---|---|---|
| 2003/0007823 | A1* | 1/2003 | Tsuchiya et al. | 400/617 |
| 2004/0076458 | A1* | 4/2004 | Itou | 400/693 |
| 2004/0173706 | A1* | 9/2004 | Takagi et al. | 242/338 |
| 2004/0175221 | A1* | 9/2004 | Sekino | 400/613 |
| 2005/0024464 | A1* | 2/2005 | Takagi | 347/104 |
| 2005/0284975 | A1* | 12/2005 | Fukushima et al. | 242/340 |
| 2007/0009310 | A1* | 1/2007 | Kato | 400/691 |
| 2007/0081067 | A1* | 4/2007 | Omori et al. | 347/108 |
| 2008/0069623 | A1* | 3/2008 | Kobayashi et al. | 400/621.1 |
| 2008/0075502 | A1* | 3/2008 | Tada et al. | 399/111 |
| 2009/0244246 | A1* | 10/2009 | Nakamaki et al. | 347/104 |
| 2010/0200166 | A1* | 8/2010 | Watanabe | 156/384 |
| 2011/0170929 | A1* | 7/2011 | Nakayama | 400/619 |
| 2011/0267396 | A1* | 11/2011 | Yamamoto et al. | 347/16 |
| 2012/0082499 | A1* | 4/2012 | Murakami | 400/582 |
| 2013/0099638 | A1* | 4/2013 | Pala | 312/223.2 |
| 2013/0328959 | A1* | 12/2013 | Akira et al. | 347/16 |
| 2014/0079461 | A1* | 3/2014 | Obata et al. | 400/635 |
| 2014/0099149 | A1* | 4/2014 | Kikura et al. | 400/619 |

FOREIGN PATENT DOCUMENTS

| | | |
|---|---|---|
| CN | 102615999 | 8/2012 |
| JP | 3-180863 | 8/1991 |
| JP | 4-112066 | 4/1992 |
| JP | 5-293794 | 11/1993 |
| JP | 10-129921 | 5/1998 |
| JP | 2000-053315 | 2/2000 |
| JP | 2001-183954 | 7/2001 |
| JP | 2003-098765 | 4/2003 |
| JP | 2005-255298 | 9/2005 |
| JP | 2006-227141 | 8/2006 |
| JP | 2008-119838 | 5/2008 |
| JP | 2010-58515 | 3/2010 |
| JP | 2011-110813 | 6/2011 |

OTHER PUBLICATIONS

U.S. Appl. No. 13/950,867, filed Jul. 25, 2013.
Chinese official action dated Jan. 6, 2015 in corresponding. Chinese patent application No. 2013 1045 51 69.1.

* cited by examiner

IMAGE FORMING APPARATUS AND METHOD OF SETTING PRINT MEDIA

CROSS-REFERENCE TO RELATED APPLICATIONS

This patent application is based on and claims priority pursuant to 35 U.S.C. §119 to Japanese Patent Application Nos. 2012-223716, filed on Oct. 6, 2012, and 2013-126189, filed on Jun. 15, 2013, in the Japan Patent Office, the entire disclosure of each of which is hereby incorporated by reference herein.

BACKGROUND

1. Technical Field

This disclosure relates to an image forming apparatus and a method of setting a print medium, and more particularly to an image forming apparatus using a roll-shaped print medium having an adhesive face and a method of setting the print medium.

2. Description of the Related Art

Image forming apparatuses are used as printers, facsimile machines, copiers, plotters, or multi-functional devices having, e.g., two or more of the foregoing capabilities. For example, there is known an image forming apparatus for forming an image on a roll-shaped print medium, e.g., a label printer for printing on a print medium having an adhesive face, such as a tape or an unmounted label sheet, with no release sheet adhering to the adhesive face (hereinafter also referred to as "linerless label sheet") and cutting the print medium into a predetermined length after the printing to obtain a print medium piece (hereinafter also referred to as a "label piece").

For example, in an image forming apparatus using a roll sheet, a sheet storage unit loaded with the roll sheet is configured to be drawable from an apparatus body (see JP-2005-255298-A).

However, such a roll-shaped print medium is a continuous sheet. In a configuration in which the roll-shaped print medium is held and conveyed by a continuous belt, the print medium may be skewed or wrinkled by the conveyance if an initial setting position is slightly tilted.

For such a drawable sheet storage unit like that proposed in JP-2005-255298-A, even if a roll body is set into the sheet storage unit and the sheet storage unit is pushed into the apparatus body, a roll sheet may not be set to a conveyance unit in such a manner that the roll sheet is not skewed or wrinkled.

In other words, there is a demand for enhancing an operability (setting performance) in setting a roll sheet in a conveyable state while preventing skew and wrinkle of the roll sheet.

BRIEF SUMMARY

In at least one exemplary embodiment of this disclosure, there is provided an image forming apparatus including an apparatus body, a sheet feeder to load a roll body including a recording medium wound around, an image forming unit to form an image on the recording medium, and a conveyance unit including a conveyance belt to convey the recording medium drawn out from the roll body so as to oppose the recording medium to the image forming unit. The sheet feeder and the conveyance unit are integrated as a sheet feed conveyance unit. The sheet feed conveyance unit is configured to load the roll body in at least the sheet feeder and be drawable from the apparatus body to a position at which the conveyance belt is visible.

In at least one exemplary embodiment of this disclosure, there is provided a method of setting a recording medium having an adhesive face with no release sheet adhering on the adhesive face. The method includes steps of drawing a sheet feed conveyance unit from an apparatus body in a direction perpendicular to a conveyance direction in which the recording medium is conveyed by a conveyance unit including a conveyance belt on which the adhesive face of the recording medium is releasably attached, the conveyance unit and a sheet feeder integrated as the sheet feed conveyance unit insertable into and drawable from the apparatus body, the sheet feeder configured to load a roll body including the recording medium wound around; loading the roll body into the sheet feeder from a direction along the conveyance direction; drawing the recording medium from the roll body loaded in the sheet feeder; and adhering the adhesive face of the recording medium drawn from the roll body onto the conveyance belt to set the recording medium on the conveyance belt.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
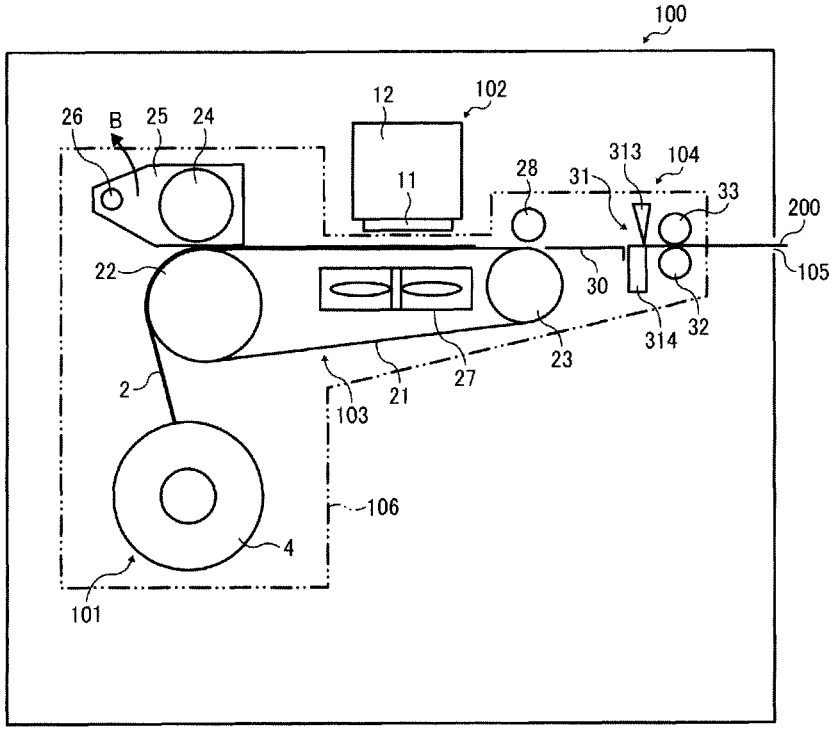
FIG. 1 is a front view of a mechanical section of an image forming apparatus according to a first exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

The term "image formation" used herein includes providing not only meaningful images, such as characters and figures, but meaningless images, such as patterns, to print media (in other words, the term "image formation" also includes causing liquid droplets to land on print media).

The term "ink" is not limited to "ink" in a narrow sense, unless specified, but is used as a generic term for any types of liquid usable as targets of image formation. For example, the term "ink" includes recording liquid, fixing solution, liquid, and so on.

The term "image forming apparatus", unless specified, also includes both serial-type image forming apparatus and line-type image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to a first embodiment of the present disclosure is described with reference to FIGS. 1 to 3.

Figure 2:
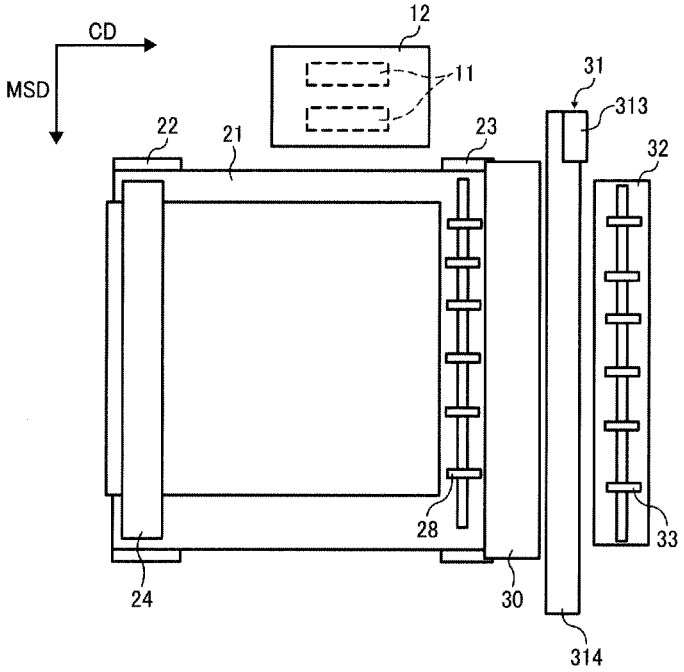
FIG. 2 is a schematic plan view of the mechanical section of FIG. 1.

FIG. 1 is a front view for explaining a mechanical section of the image forming apparatus. FIG. 2 is a schematic plan view for explaining the mechanical section. FIG. 3 is a front view of a portion of the mechanical section of FIG. 2.

The image forming apparatus includes an apparatus body 100 in which a sheet feeder 101, an image forming unit 102 serving as an image forming device, a conveyer 103 serving as a conveyance unit, and an output conveyer 104 serving as an output conveyance unit.

A roll body 4 having a print medium 2 wound like a roll is loaded into the sheet feeder 101.

Figure 3:
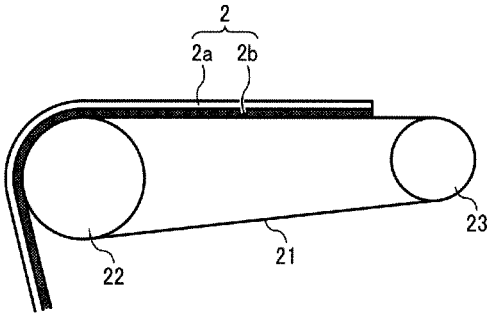
FIG. 3 is a front view for explaining a portion of the mechanical section.

The print medium 2 is a continuous body having an adhesive layer (hereinafter also referred to as an "adhesive face") 2*b* formed over a medium 2*a* on which an image can be formed (hereinafter referred to as a "print face") as shown in FIG. 3. The print medium 2 is a linerless label sheet rolled in a state in which no mount (a release sheet or a separator) is pasted on the adhesive face 2*b*. However, the print medium is not limited thereto but may be a roll-shaped print medium.

The image forming unit 102 includes a carriage 12 provided with a recording head 11 constituted by a liquid ejection head for ejecting droplets to the print medium 2. The carriage 12 is held movably on a guide member, and is reciprocated in a main scanning direction MSD which is orthogonal to a conveyance direction CD (a feed direction) of the print medium 2.

The recording head 11 is a liquid ejection head having two nozzle lines. Two recording heads 11 are used to eject ink droplets having respective colors of black (K), cyan (C), magenta (M) and yellow (Y) in four nozzle lines, respectively. However, the present disclosure is not limited thereto but a line type head can also be used.

Moreover, the image forming unit 102 is not limited to the configuration of the liquid ejection head but various image forming units for forming an image in contact and non-contact can be used.

In the conveyer 103, a protection belt 21 serving as an endless conveyance belt is disposed below the recording head 11. The protection belt 21 is laid around a conveyance roller 22 and a driven roller 23 to which tension is applied so as to enable a circulation.

At this time, it is preferable that the protection belt 21 should not have adhesiveness to the adhesive face 2*b*. In order to prevent the print medium 2 from being loosened from the protection belt 21 in conveyance, however, it is also possible to have such small adhesiveness as to enable re-release from the adhesive face 2*b*. By putting the protection belt 21 on the adhesive face 2*b*, it is possible to protect the adhesive face 2*b*, and at the same time, to prevent the adhesive face 2*b* from coming in contact with an inner part of the apparatus. Consequently, conveyance stability can be obtained, and at the same time, the protection belt 21 can be released from the adhesive face 2*b*. Therefore, it is possible to output only the print medium 2.

In other words, in the present embodiment, the protection belt 21 is a conveyance belt and also has a function for protecting the adhesive face 2*b* of the print medium 2.

An opposed roller 24 is disposed opposite to the conveyance roller 22. Paired conveyance rollers (paired rotors) including the conveyance roller 22 and the opposed roller 24 constitute a conveyance unit for interposing the print medium 2 and the protection belt 21 therebetween together with each other and conveying them to an image formation area through the recording head 11.

The opposed roller 24 is rotatably held on a holder member 25. The holder member 25 can be rotated and moved in a direction of an arrow B in FIG. 1 around a shaft 26. Moreover, the opposed roller 24 is pressurized toward the conveyance roller 22 side by a pressurizing member such as a spring.

Furthermore, a large number of sucking holes are formed on the protection belt 21. A sucking fan 27 is disposed on an inside of the protection belt 21. The sucking fan 27 serves to suck the print medium 2 toward a front face of the protection belt 21 through the sucking holes opposite to the recording head 11 of the image forming unit 102.

Although there has been employed the structure in which the print medium 2 is adsorbed to the protection belt 21 by suction, the present disclosure is not limited thereto but the print medium 2 can also be adsorbed by electrostatic force. Moreover, it is also possible to fix the print medium 2 so as not to be loosened from the protection belt 21 by utilizing the adhesiveness of the adhesive face 2*b* of the print medium 2.

Furthermore, a spur roller 28 is disposed opposite to the driven roller 23.

In the output conveyer 104, a cutter unit 31 is disposed on a downstream side in the conveyance direction of a guide member 30 for guiding the print medium 2 fed from a part between the protection belt 21 and the spur roller 28. The cutter unit 31 is a cutter for cutting the print medium 2 into a predetermined length to form a print medium piece (a label piece) 200.

The cutter unit 31 has a lower blade 314 serving as a receiving member for receiving the print medium 2 and a cutting blade (an upper blade: a cutter) 313 for cutting the print medium 2 together with the lower blade 314, and the upper blade 313 is moved in a main scanning direction MSD, thereby cutting the print medium 2.

An output roller 32 is disposed on a downstream side of the cutter unit 31. A spur roller 33 is disposed opposite to the output roller 32. A leading end of the label piece 200 in a cutting state by the cutter unit 31 is held in a feeding state to an output port 105 of the apparatus body 100 by the output roller 32 and the spur roller 33.

A front face of the output roller 32 which holds the label piece 200 is subjected to a non-adhesive treatment (a treatment for preventing an adhesive face from adhering), for example, and can release the adhesive face 2*b* of the label piece 200. In this case, the output roller 32 itself can also be formed by a releasable material.

In the image forming apparatus, the sheet feeder 101, the conveyer 103 and the output conveyer 104 are integrated as a sheet feed conveyance unit 106 and the sheet feed conveyance unit 106 is attached to the apparatus body 100 so as to be insertable into and drawable from the apparatus body 100, which is described below in detail.

Although the description has been given with the structure in which the image formation is carried out with the adhesive face 2*b* of the print medium 2 set onto the protection belt 21 side in the present embodiment, it is also possible to employ a structure in which the image information is carried out over the adhesive face 2*b* of the print medium 2 (the following embodiments are the same). In this case, it is preferable that a front face of the opposed roller 24 should be subjected to the non-adhesive treatment (the treatment for preventing the adhesive face from adhering). Moreover, the protection belt 21 does not need to be subjected to the non-adhesive treatment but serves as a simple conveyance belt.

Figure 4:
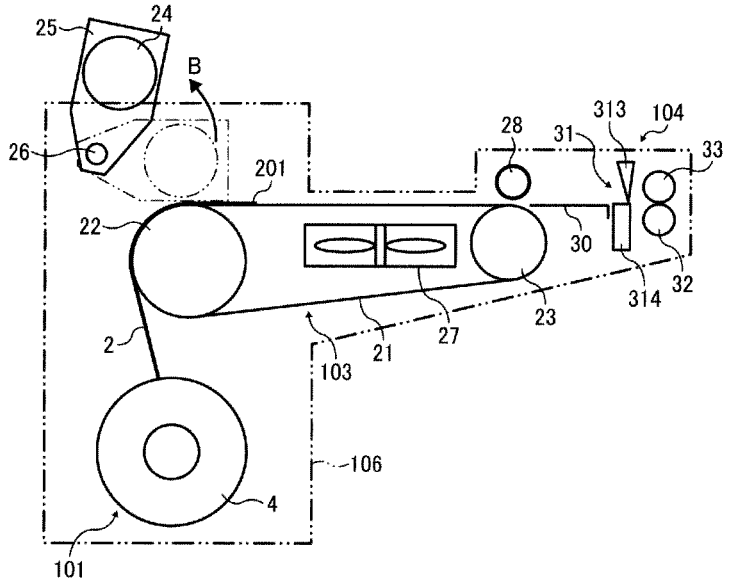
FIG. 4 is a front view for explaining a sheet feed conveyance unit which is to be used for description of summary of a procedure for setting the print medium in the image forming apparatus.

Next, the summary of a procedure for setting the print medium in the image forming apparatus and the summary of a print operation will also be described with reference to FIG. 4. FIG. 4 is a front view for explaining a sheet feed conveyance unit part which is to be used for the description.

First, as shown in FIG. 4, the holder member 25 of the opposed roller 24 is displaced in the direction of the arrow B from a position shown in a broken line to a position shown in a solid line so that a part between the opposed roller 24 and the conveyance roller 22 is brought into an opening state and the roll body 4 is loaded into the sheet feeder 101.

The print medium 2 is peeled and drawn from the roll body 4, and a leading end 201 of the print medium 2 is caused to pass through the part between the opposed roller 24 and the conveyance roller 22 and is thus set into a position on the protection belt 21 shown in the drawing.

Then, the holder member 25 of the opposed roller 24 is displaced in an opposite direction to the direction of the arrow B to interpose the print medium 2 and the protection belt 21 together between the conveyance roller 22 and the opposed roller 24.

The conveyance roller 22 is rotated and driven so that the adhesive face 2*b* of the print medium 2 is conveyed in a protection state with the protection belt 21 and a desirable image is formed by the recording head 11 of the image forming unit 102.

The protection belt 21 is peeled from the print medium 2 having the image formed thereon, and only the print medium 2 is fed to the output conveyer 104 and is cut in a predetermined position by the cutter unit 31. Thus, the label piece 200 is obtained. The label piece 200 is held in a removable state from the output port 105 of the apparatus body 100 between the output roller 32 and the spur roller 33.

Next, a method of setting a print medium in an image forming apparatus of the present embodiment is described with reference to FIGS. 5 to 8.

Figure 5:
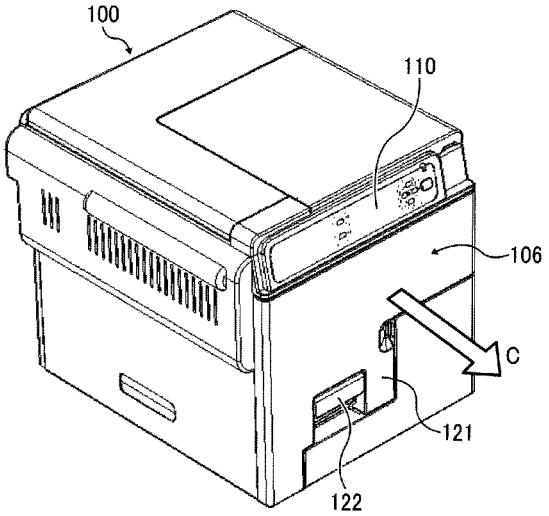
FIG. 5 is a perspective view for explaining an outer appearance of the image forming apparatus which is to be used for description of a method of setting the print medium in first exemplary the embodiment.
Figure 6:
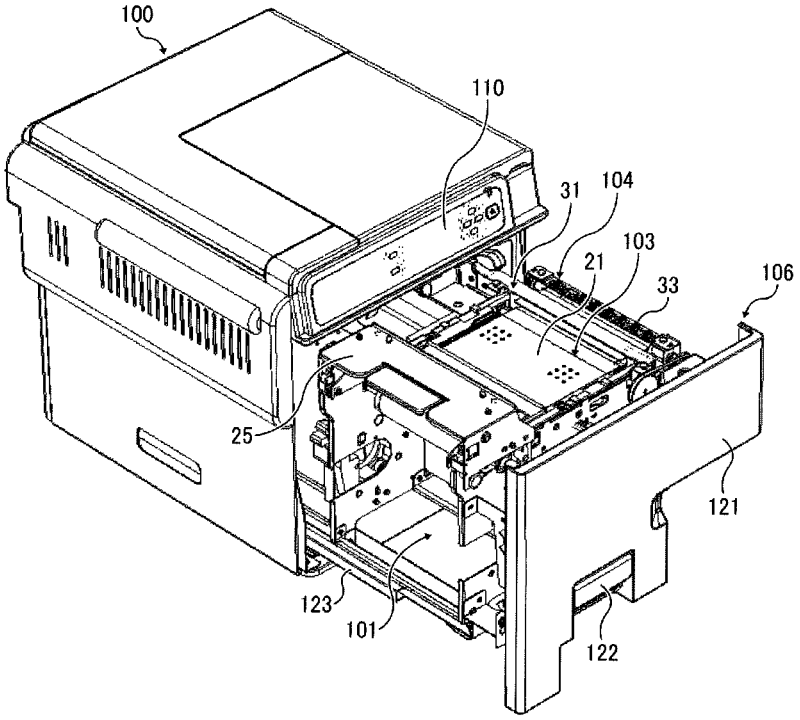
FIG. 6 is a perspective view for explaining a state in which the sheet feed conveyance unit is drawn out of an apparatus body.
Figure 7:
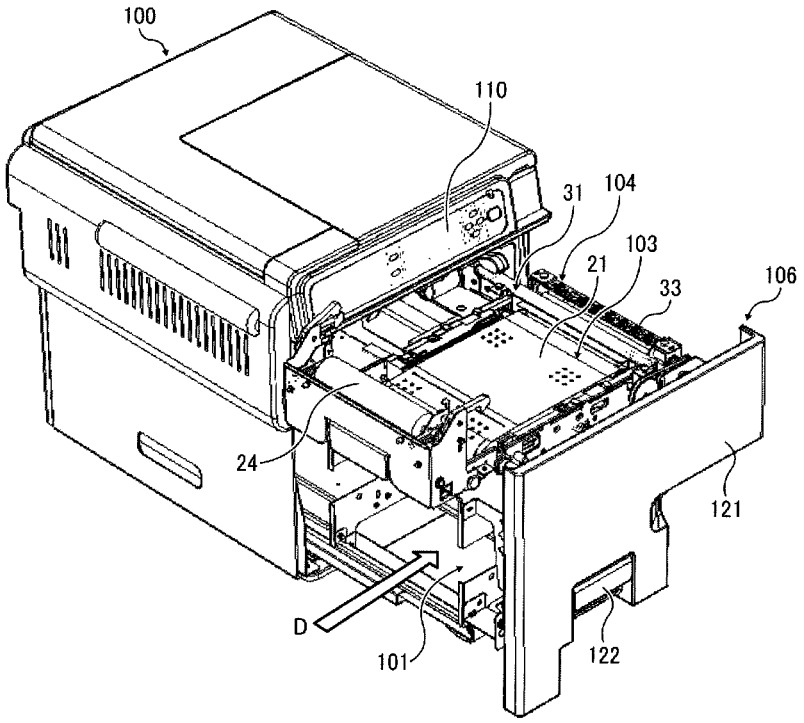
FIG. 7 is a perspective view for explaining a state in which opposed rollers are released.
Figure 8:
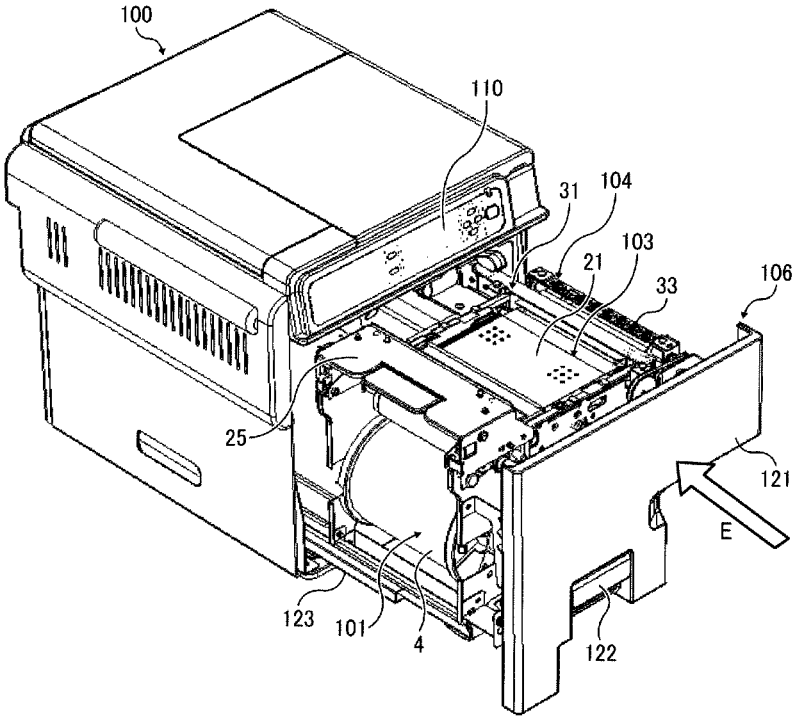
FIG. 8 is a perspective view for explaining a state in which a roll body is loaded to set the print medium onto a protection belt.

FIG. 5 is a perspective view for explaining an outer appearance of an image forming apparatus which is to be used for the description. FIG. 6 is a perspective view for explaining a state in which a sheet feed conveyance unit is drawn from an apparatus body. FIG. 7 is a perspective view for explaining a state in which an opposed roller is released. FIG. 8 is a perspective view for explaining a state in which a roll body is loaded and the print medium is thus set onto a protection belt.

As described above, when the print medium 2 is to be set onto the protection belt 21, it is roll-shaped in a state in which the adhesive face 2*b* has no release sheet. For this reason, it is necessary to draw the print medium 2 from the roll body 4 while peeling the adhesion of the adhesive face 2*b*. When the print medium 2 drawn from the roll body 4 is to be set onto the protection belt 21 via the part between the opposed roller 24 and the conveyance roller 22, moreover, the adhesive face 2*b* should be prevented from adhering to other members. If crinkles or wrinkles are generated when the adhesive face 2*b* of the print medium 2 is to adhere onto the protection belt 21 (in a releasable state), furthermore, stable conveyance cannot be carried out.

Thus, it is harder to set the print medium 2 having the adhesive face 2*b* exposed as compared with an ordinary roll sheet, and it is necessary to enhance an operability of an operation for setting the print medium 2.

For this purpose, it is necessary to enable the execution of the operation for setting the print medium 2 onto the protection belt 21 in an excellent visibility state. If the operation for setting the print medium 2 is executed in the apparatus body 100, however, an outer cover of the apparatus body 100 and the other components are obstructive so that the visibility is damaged and the setting operation becomes hard to perform. Even if only the sheet feeder 101 is insertable into and drawable from the apparatus body 100 as in the related art, moreover, correlation of a position to the protection belt 21 is eliminated so that the setting onto the protection belt 21 is to be carried out in the apparatus and the setting operation thus becomes hard.

In the present embodiment, as described above, the sheet feeder 101 and the conveyer 103 and output conveyer 104 are integrated into the sheet feed conveyance unit 106 as shown in FIGS. 1 and 4. As shown in FIG. 6, the sheet feed conveyance unit 106 is attached to the apparatus body 100 so as to be drawable from the apparatus body 100.

When a face of the apparatus body 100 on which a control panel 110 is provided is set to be the front face of the apparatus body 100, an outer cover 121 which is an outer part of the apparatus body 100 is integrally attached to a front face side of the sheet feed conveyance unit 106. In other words, the sheet feed conveyance unit 106 has the outer cover 121 on the front face side in a drawing direction. Moreover, a knob 122 for drawing is attached to the front face side.

Furthermore, the drawing direction of the sheet feed conveyance unit 106 is orthogonal to the conveyance direction CD of the print medium 2 (a medium conveyance direction) and is set to be a front face direction of the apparatus body 100. The sheet feed conveyance unit 106 is inserted and drawn out by a slide rail 123 (FIG. 6).

In the present embodiment, the sheet feeder 101 is disposed below the protection belt 21 of the conveyer 103, and a direction for loading the roll body 4 onto the sheet feeder 101 is also set to be a direction along a direction for conveying the print medium 2 in the conveyer 103.

By disposing the sheet feeder 101 below the protection belt 21, thus, it is possible to reduce a size of the apparatus in the conveyance direction (a length in a transverse direction of FIG. 2).

By the structure, when the roll body 4 is to be newly (or replacedly) loaded onto the sheet feeder 101 and the print medium 2 is to be set onto the protection belt 21, the knob 122 is first gripped and is drawn in a direction of an arrow C as shown in FIG. 5. Consequently, the sheet feed conveyance unit 106 can be drawn from the apparatus body 100 as shown in FIG. 6.

At this time, the roll body 4 can be loaded onto the sheet feeder 101 in the conveyance direction of the print medium 2 in the conveyer 103 and the sheet feed conveyance unit 106 is drawable up to a position in which the protection belt (the conveyance belt) 21 can be seen visually.

As shown in FIG. 7, the opposed roller 24 is retracted above to open the part between the opposed roller 24 and the conveyance roller 22 as described above (see FIG. 4).

Then, the roll body 4 is loaded onto the sheet feeder 101 in a direction of an arrow D and the print medium 2 is peeled and drawn from the roll body 4 to cause the leading end 201 of the print medium 2 (FIG. 4) to pass through the part between the opposed roller 24 and the conveyance roller 22 so that the print medium 2 is set into a predetermined position on the protection belt 21 as described above.

At this time, a small number of members disturb the operation for setting the print medium 2, and the setting work can be carried out in an excellent visibility state.

As shown in FIG. 8, thereafter, the opposed roller 24 is returned into an original condition and the print medium 2 and the protection belt 21 are thus interposed together between the conveyance roller 22 and the opposed roller 24.

Subsequently, the sheet feed conveyance unit 106 is pushed into the apparatus body 100 in a direction of an arrow E in FIG. 8. Consequently, the setting work is completed.

At this time, the sheet feed conveyance unit 106 can be accommodated in the apparatus body 100 in a state in which a positional relationship between the roll body 4 of the sheet feeder 101 and the protection belt 21 of the conveyer 103 is not lost and the print medium 2 is set onto the protection belt 21 without generating a skew or a wrinkle. Consequently, it is also possible to obtain a stable conveyance property of the print medium 2.

By employing the structure in which the sheet feeder, the conveyer and the output conveyer are integrated into the sheet feed conveyance unit and the sheet feed conveyance unit is insertable into and drawable from the apparatus body, thus allowing enhancement of the operability in setting the print medium having the adhesive face exposed, for example, a linerless label sheet.

There is shown the case of the print medium 2 having the adhesive face 2*b* exposed in which effects are produced more remarkably. However, the effect of setting to the belt or suppression of a skew or a wrinkle in conveyance is not limited to the print medium 2 having the adhesive face 2*b* exposed but the same effects can be produced in the case of the setting of the roll-shaped print medium.

With the structure in which the sheet feeder is disposed below the conveyer, particularly, the roll body is loaded in the direction along the conveyance direction of the print medium 2 in the conveyer 103. If the sheet feeder or the conveyer is maintained to be disposed in the apparatus body 100, it is hard to pull out or provide the print medium. In other words, it is necessary to load the roll body 4 from a diagonally left downward direction shown in FIG. 5, while the print medium 2 can be set from only an upper part in which the protection belt 21 can be seen. More specifically, it is necessary to take a complicated procedure for setting the roll body 4 to the apparatus body 100 in the transverse direction, then giving access to the roll body 4 from above again to pull up the leading end of the print medium 2, and setting the print medium 2 onto the protection belt 21. In the present embodiment, therefore, it is possible to pull out the sheet feeder from the apparatus body 100 integrally with the conveyer. Consequently, it is possible to easily carry out the operation for loading the roll body 4 and setting the print medium 2 to the conveyer 103.

In this case, the sheet feed conveyance unit 106 can also be constituted by the sheet feeder 101 and the conveyer 103 (excluding the output conveyer). By forming the output conveyer 104 including the cutter into a unit together as described above, it is possible to obtain the following advantages.

In other words, in the case in which a jam occurs in the print medium 2, it is necessary to eliminate a jammed sheet. By pulling out the whole part including the output conveyer 104, however, it is also possible to carry out the jam processing in an excellent visibility state.

On the other hand, with the structure in which the output conveyer 104 is left in the apparatus body 100, the print medium 2 remains on the protection belt 21 in the state in which the jam occurs. If the conveyer 103 is pulled out in this state, a jammed portion is torn off (a phenomenon referred to as "division into pieces") when the jammed portion is provided across the output conveyer 104 and the conveyer 103. Consequently, it is further hard to execute the jam processing. By enabling the whole part including the conveyer 103 and the output conveyer 104 to be drawn from the sheet feeder 101, it is possible to eliminate the drawback.

Figure 9:
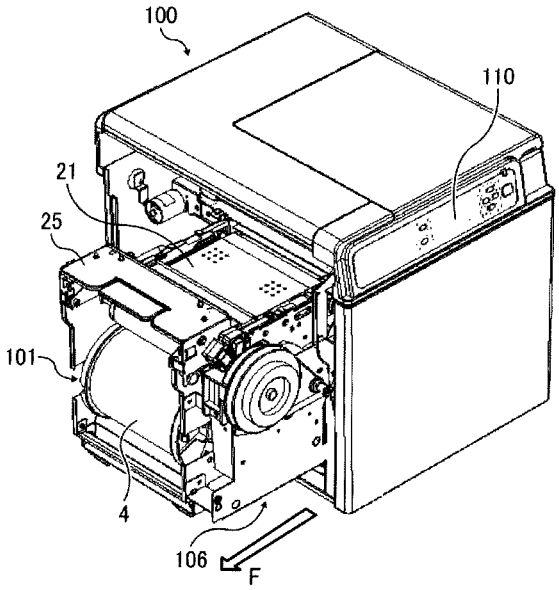
FIG. 9 is a perspective view for explaining a state in which a sheet feed conveyance unit is drawn out of an apparatus body which is to be used for description of a second exemplary embodiment of the present disclosure.

Next, a second exemplary embodiment of the present disclosure is described with reference to FIG. 9. FIG. 9 is a perspective view for explaining a state in which a sheet feed conveyance unit is drawn from an apparatus body which is to be used for description of the exemplary embodiment.

In the present embodiment, a drawing direction of a sheet feed conveyance unit 106 is set to be a direction of an arrow F (a direction along a conveyance direction). In this case, when a face of an apparatus body 100 where a control panel 110 is provided is set to be a front face, a sheet feed conveyance unit 106 is inserted and drawn and a roll body 4 is loaded from a side face of the apparatus body 100.

With the structure, similarly, it is possible to carry out an operation for setting a print medium 2 to a protection belt 21 in an excellent visibility state.

Figure 10:
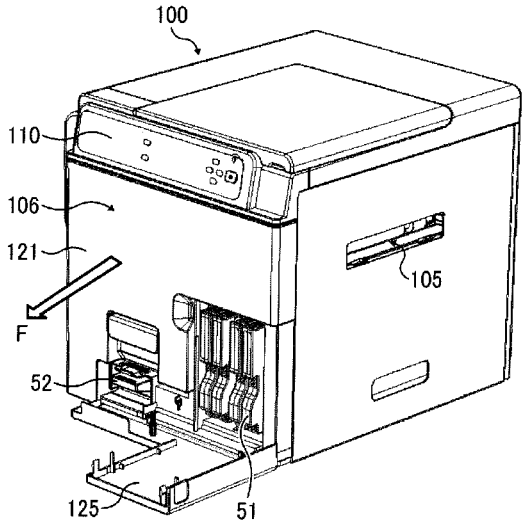
FIG. 10 is a perspective view for explaining an image forming apparatus which is to be used for description of a third exemplary embodiment of the present disclosure.

Next, a third exemplary embodiment of the present disclosure is described with reference to FIG. 10. FIG. 10 is a perspective view for explaining an image forming apparatus which is to be used for description of the exemplary embodiment.

As described above, a recording head 11 formed by a liquid ejection head is used for an image forming unit 102. As shown in FIG. 10, therefore, an ink cartridge 51 to be a liquid cartridge for supply to the recording head 11 can be exchangeably attached to an apparatus body 100. Moreover, a waste liquid tank 52 for accommodating a waste liquid of an ink generated by a maintenance and recovery operation (a maintenance operation) for maintaining and recovering performance of the recording head 11 can also be exchangeably attached to the apparatus body 100.

An outer cover 121 of a sheet feed conveyance unit 106 is openably provided with a sub-cover 125 for opening/closing the portions of the ink cartridge 51 and the waste liquid tank 52. By opening the sub-cover 125, it is possible to pull out the ink cartridge 51 and the waste liquid tank 52 in the same direction as the drawing direction of the sheet feed conveyance unit 106 (a direction of an arrow F).

Thus, a drawing direction of the sheet feed conveyance unit 106 is set to be identical to that of the ink cartridge and the waste liquid tank (or either of them), and the drawing direction is set to be a direction of a front face of the apparatus body 100 (a face on which a control panel 110 is provided is set to be the front face). Consequently, a face (direction) to be operated by a user is unified so that convenience can be enhanced.

Even if the drawing direction of the sheet feed conveyance unit and that of the ink cartridge and the waste liquid tank (or either of them) are identical to each other, the exchange or replenishment of the print medium and the ink cartridge exchange and waste liquid tank exchange are separate operations from each other. By providing an openable sub-cover for the ink cartridge and the waste liquid tank, therefore, it is possible to carry out opening/closing if necessary. Thus, the operation can be simplified.

Moreover, the drawing direction of a control panel 110 for displaying a residual amount of each color ink, a situation of a waste liquid tank or the like and inputting necessary information and the sheet feed conveyance unit 106, the removal/insertion direction of the ink cartridge 51, and the removal/insertion direction of the waste liquid tank 52 are set to be identical to each other. Consequently, an operation display face and the face (direction) to be operated by the user are unified so that the convenience can be enhanced.

Figure 11:
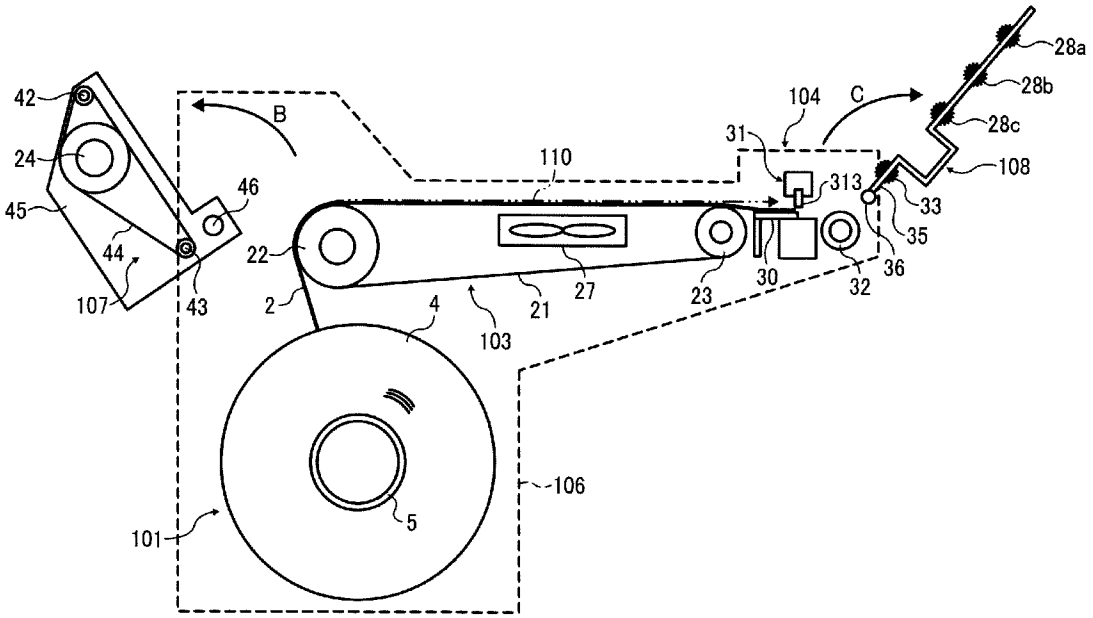
FIG. 11 is a front view for explaining a mechanical section of an image forming apparatus according to a fourth exemplary embodiment of the present disclosure.

Next, an image forming apparatus according to a fourth exemplary embodiment of the present disclosure is described with reference to FIG. 11. FIG. 11 is a front view for explaining a mechanical section of the image forming apparatus.

Since a basic structure of the present embodiment is the same as that described in the first exemplary embodiment, different respects are mainly described.

In the image forming apparatus, a guide unit 107 for guiding a print medium 2 in conveyance and return of the print medium 2 is disposed in an apparatus body 100. Moreover, spur rollers 28*a*, 28*b* and 28*c* are disposed on a driven roller 23 side.

The guide unit 107 has a second roller 42 serving as a separation roller disposed on a downstream side of an opposed roller 24 serving as a first roller constituting a conveyer 103 and an upstream side of an image forming unit 102, and a third roller 43 disposed on an opposite side to the second roller 42 with the opposed roller 24 interposed therebetween, and an endless guide belt 44 is laid among the opposed roller 24, the second roller 42 and the third roller 43.

The guide belt 44 is a belt-shaped member containing polyimide as a base material and having, on a surface layer, a mold releasing layer (for example, silicone coating) which enhances a mold releasing property from an adhesive face 2*b* of the print medium 2.

The opposed roller 24, the second roller 42 and the third roller 43 are rotatably held on a holder member 45. The holder member 45 is rotatably disposed with a shaft 46 set to be a rotation center and can be displaced between a position in which the opposed roller 24 is opposed to a conveyance roller 22 and a position in which the opposed roller 24 is separated from the conveyance roller 22 and a part between the opposed roller 24 and the conveyance roller 22 is thus opened.

Moreover, the opposed roller 24 is pressurized toward the conveyance roller 22 side by a pressurizing unit such as a spring. Similarly, the second roller 42 is also pressurized toward a protection belt 21 side by the pressurizing unit such as the spring.

On the other hand, the spur rollers 28*a* to 28*c* are disposed in an orthogonal direction to a conveyance direction respectively and constitute a spur roller group. The two spur rollers 28*a* and 28*b* on an upstream side are opposed to the protection belt 21 and the spur roller 28*c* on the most downstream side is opposed to a receiving member 30 of an output conveyer 104.

The spur rollers 28*a* to 28*c* and a spur roller 33 are integrally held on a spur holder 35 serving as a guide member of the print medium 2. The spur holder 35 is disposed to be rotationally movable in a position in which the spur rollers 28*a* to 28*c* and the spur roller 33 are separated from the protection belt 21 or an output roller 32 with a shaft 36 set to be a rotation center.

In the present embodiment, the guide unit 107 is a first medium pressing unit disposed on an upstream side in a medium conveyance direction of the image forming unit 102. However, the opposed roller 24, the second roller 42 and the guide belt 44 press the print medium 2. In this case, if the guide belt 44 is not provided, the opposed roller 24 serves as a first medium pressing unit.

In the guide unit 107 serving as the first medium pressing unit, the holder member 45 is held rotatably with the shaft 46 set to be a rotation center as described above. Therefore, a downstream side in a medium conveyance direction is provided rotatably in a separating direction from a passage from the conveyer 103 to the output conveyer 104 with an upstream side in the medium conveyance direction set to be a rotation center, and can be retracted to an opening position in which the passage is to be opened (a position in FIG. 11: movable in a direction of an arrow B).

Moreover, the spur holder 35, the spur rollers 28*a* to 28*c* held thereon and the spur roller 33 constitute a second medium pressing unit 108 disposed on the downstream side in the medium conveyance direction of the image forming unit 102.

In the second medium pressing unit 108, the spur holder 35 is held rotatably with the shaft 36 set to be a rotation center as described above. Consequently, the upstream side in the medium conveyance direction with the downstream side in the medium conveyance direction set to be the rotation center is provided rotatably in the separating direction from the passage from the conveyer 103 to the output conveyer 104, and can be retracted to the opening position in which the passage is to be opened (a position in FIG. 11: movable in a direction of an arrow C).

In the case in which an image is formed on an adhesive face 2*b* side of the print medium 2, particularly, the guide unit 107 guides the print medium 2 in conveyance and return, thereby preventing the print medium 2 from being sucked into the opposed roller 24.

In other words, even if a front face of the opposed roller 24 is subjected to a non-adhesive treatment, there is a possibility that the adhesive face 2*b* of the print medium 2 might be pasted and sucked into a peripheral face of the opposed roller 24 by using only the opposed roller 24 because of a small curvature of the opposed roller 24. In this case, it is preferable that the curvature of the opposed roller 24 should be increased. However, a size of a nipping area between the opposed roller 24 and the conveyance roller 22 is reduced so that stable conveyance force cannot be obtained.

Therefore, the print medium 2 is pressed and conveyed by the guide belt 44 in the conveyance and the guide belt 44 is reliably separated from the print medium 2 by the second roller 42 serving as a separation roller having a small curvature. Consequently, the print medium 2 is prevented from being sucked into the opposed roller 24 in the conveyance.

Also when the print medium 2 is to be returned, moreover, the adhesive face 2*b* side of the print medium 2 is received by the guide belt 44 so that the print medium 2 is prevented from being sucked into the opposed roller 24.

In a stage in which the image formation is ended and the print medium 2 is cut by a cutter unit 31, a leading end of the print medium 2 is placed in a position of the cutter unit 31 and an area of the print medium 2 which is opposed to the image forming unit 102 serves as an unused area. If a next image forming operation is exactly restarted, the unused area of the print medium 2 is useless. Therefore, the print medium 2 is returned in a return direction (a reverse direction to the conveyance direction) to a position in which the leading end of the print medium 2 reaches this side (the upstream side) of the image forming unit 102.

In the case in which the print medium 2 having an adhesive face without a release sheet such as a linerless label sheet is roll-shaped, the adhesive face is to be peeled when the print medium 2 is to be drawn from the roll body 4. For this reason, the print medium 2 thus peeled is curled greatly in a reverse direction to a winding direction.

In order to prevent the leading end of the print medium 2 from being loosened from the protection belt 21 over the conveyer 103 due to the curl of the print medium 2, in the present embodiment, the guide unit 107 to be the first medium pressing unit is disposed on the upstream side in the medium conveyance direction of the image forming unit 102 and the second medium pressing unit 108 is disposed on the downstream side in the medium conveyance direction of the image forming unit 102, and the print medium 2 is pressed onto the protection belt 21 so as not to be loosened when the print medium 2 is to be set.

Consequently, the print medium 2 can be prevented from coming in contact with the image forming unit 102 due to the looseness of the leading end of the set print medium 2. Thus, it is possible to stably set the print medium 2.

When the print medium 2 drawn from the roll body 4 is to be set onto the protection belt 21, the guide unit 107 to be the first medium pressing unit is rotated in a direction of an arrow B and the second medium pressing unit 108 is rotated in a direction of an arrow C so that both of them are moved to retraction positions to bring the conveyance passage into an opening state as shown in FIG. 11.

Then, the roll body 4 is loaded into the sheet feeder 101 to peel and pull the print medium 2 out of the roll body 4, to cause the leading end of the print medium 2 to pass through a part between the opposed roller 24 of the guide unit 107 and the conveyance roller 22, to pull the print medium 2 out till a position on this side of the cutter unit 31 and to set the print medium 2 onto the protection belt 21.

At this time, an oil content adheres to the leading end part of the print medium 2 due to a user's touch so that adhesive force is reduced because the print medium 2 is peeled and drawn from the roll body 4. Therefore, the print medium 2 is drawn up to a position exceeding the image forming unit 102 and is thus set so that a part having adhesive force reduced is not used. Thus, it is possible to prevent an adhesion failure of a label piece 200. It is preferable to cut the part having the adhesive force reduced by the cutter unit 31.

Thereafter, both the guide unit 107 to be the first medium pressing unit and the second medium pressing unit 108 are moved to a position of the conveyance passage in which the print medium 2 is pressed, and the sheet feed conveyance unit 106 is pushed into the apparatus body 100 so that the setting work is completed.

Thus, there is employed the structure in which the first and second medium pressing units for pressing the print medium onto the conveyance passage are provided, the first medium pressing unit is disposed on the upstream side in the medium conveyance direction from the image forming unit, the second medium pressing unit is disposed on the downstream side in the medium conveyance direction from the image forming unit, and the first medium pressing unit and the second medium pressing unit are provided to be retractable into an opening position in which the passage is to be opened, respectively. Consequently, it is possible to enhance an operability of an operation for setting a roll-shaped print medium.

In other words, in the case of a structure in which the second medium pressing unit cannot be retracted into the opening position, it is hard to set the print medium 2 through a passage from below the second medium pressing unit. For this reason, the leading end of the print medium 2 is to be set onto the upstream side in the conveyance direction from the second medium pressing unit. In this case, however, the leading end of the print medium 2 is loosened due to the curl and thus comes in contact with the image forming unit 102 or the second medium pressing unit, resulting in a conveyance jam or the like.

On the other hand, in order to solve the problem, the leading end of the print medium 2 should be set so as to be placed below the first medium pressing unit if the leading end of the print medium 2 is to be pressed. For this reason, it is impossible to confirm whether the setting is carried out in an accurate position or not.

The second medium pressing unit on the downstream side can be opened as in the present embodiment so that the print medium can be disposed up to a termination of the conveyance passage in the setting of the print medium 2. For this reason, the looseness of the leading end of the print medium 2 due to the curl does not cause the conveyance jam but the setting position can also be confirmed accurately.

By enabling the open passage to be opened in a state in which the first medium pressing unit and the second medium pressing unit are expanded to an opposite side in the conveyance direction (enabling the state of FIG. 11 to be brought), it is possible to open the whole conveyance passage, and furthermore, to enhance the operability of the setting operation.

Figure 12:
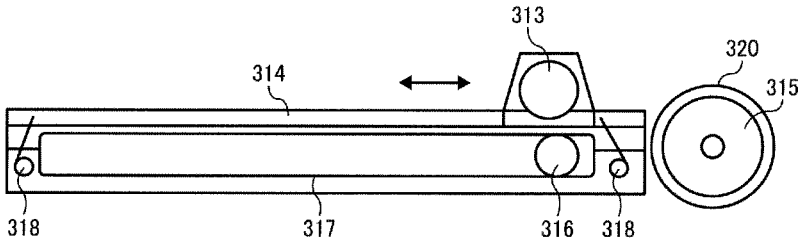
FIG. 12 is a view for explaining a cutter unit seen in a conveyance direction according to the fourth exemplary embodiment.
Figure 13:
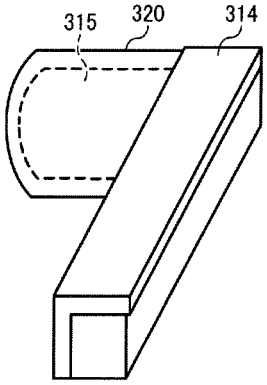
FIG. 13 is a perspective view of a portion of the cutter unit of FIG. 12.

Next, the details of the cutter unit 31 is described with reference to FIGS. 12 and 13. FIG. 12 is a view for explaining the cutter unit seen in the conveyance direction and FIG. 13 is a perspective view of a portion of the cutter unit of FIG. 12.

The cutter unit 31 interposes the print medium 2 by a rotary cutter (an upper blade) 313 and a lower blade 314, thereby cutting the print medium 2. The upper blade 313 and the lower blade 314 are subjected to the non-adhesive treatment.

A gear 316 is rotated by a motor 315 and a belt 317 is thus moved so that the upper blade 313 is moved in a main scanning direction MSD (an arrow direction). A position where the upper blade 313 is placed is detected by sensors 318 provided on both ends.

There is provided a protecting member 320 for covering the motor 315 of the cutter unit 31.

With the structure, it is possible to prevent the user from coming in contact with the motor 315 of the cutter unit 31 when pulling the sheet feed conveyance unit 106 out of the apparatus body.

Figure 14:
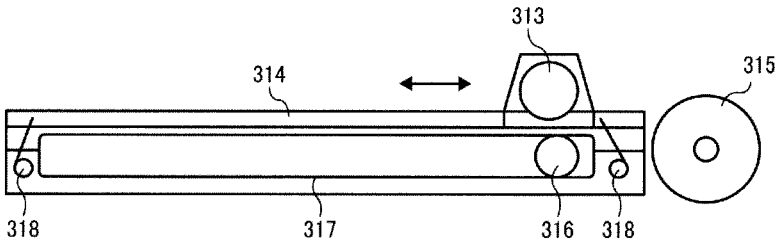
FIG. 14 is a view of a cutter unit seen in a conveyance direction according to a comparative example.
Figure 15:
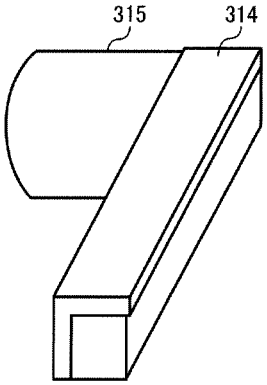
FIG. 15 is a perspective view of a portion of the cutter unit of FIG. 14.

On the other hand, as in a comparative example shown in FIGS. 14 and 15, a structure having no protecting member 320 for protecting the motor 315 has the following drawback.

Figure 16A:
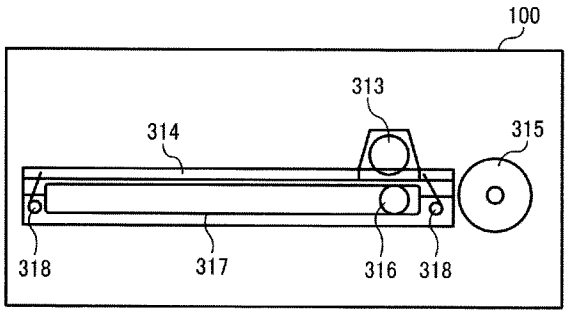
FIGS. 16A and 16B are views of a state in which the cutter unit is drawn out of an apparatus body according to the comparative example.

In other words, the upper blade 313 of the cutter unit 31, the belt 317, the gear 316 and the sensor 318 are protected. With a structure in which the motor 315 is not protected as shown in FIGS. 14 and 15, however, the user can be prevented from coming in contact with the cutter unit 31 when the sheet feed conveyance unit 106 including the cutter unit 31 is provided in the apparatus body 100 as shown in FIG. 16A.

Figure 16B:
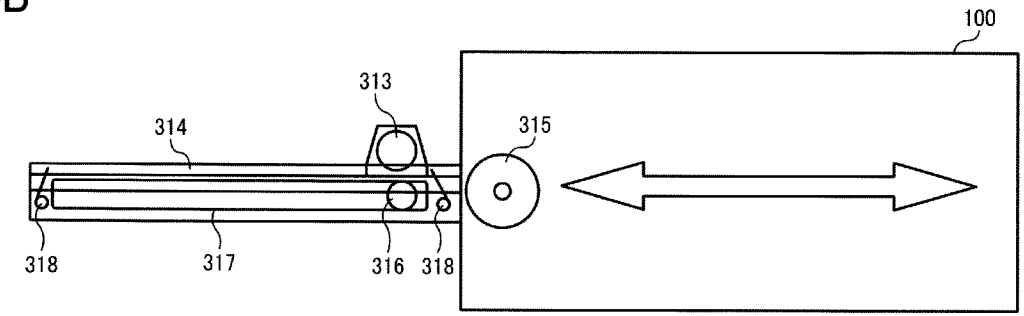

When the sheet feed conveyance unit 106 is drawn from the apparatus body 100, however, the motor 315 stays in the apparatus body 100 but is moved to a position with which the user can come in contact as shown in FIG. 16B.

By providing the protecting member 320 for protecting the motor 315 as in the present embodiment, therefore, it is possible to cause the user not to come in contact with the motor 315 also when the sheet feed conveyance unit 106 is drawn out.

Figure 17A:
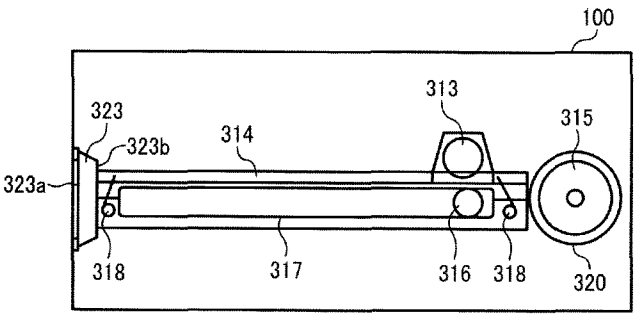
FIGS. 17A and 17B are views for explaining a cutter unit seen in a conveyance direction which are to be used for description of a fifth exemplary embodiment of the present disclosure.
Figure 17B:
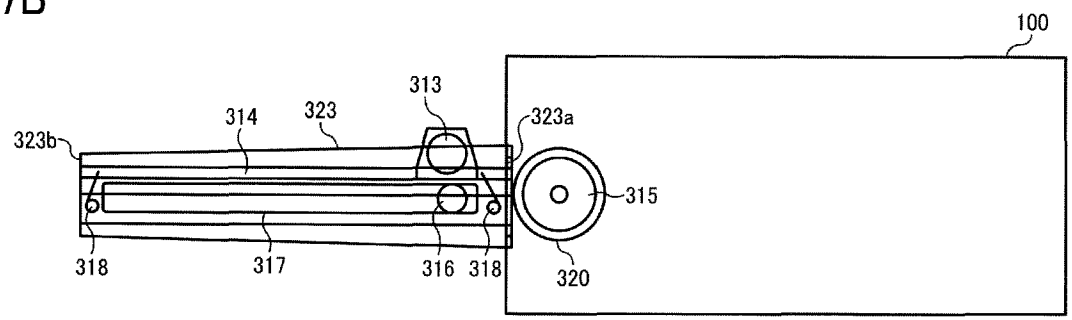

Next, a fifth exemplary embodiment of the present disclosure is described with reference to FIGS. 17A and 17B. FIGS. 17A and 17B are views for explaining a cutter unit seen in a conveyance direction which are to be used for description of the exemplary embodiment, and FIG. 17A illustrates a state in which the cutter unit is accommodated in an apparatus body and FIG. 17B illustrates a state in which the cutter unit is drawn from the apparatus body.

In the present embodiment, there is provided a protecting member 323 for protecting a lower blade 314 of a cutter unit 31. The protecting member 323 is set to be an extendable elastic member or a bellows member.

The protecting member 323 has an end 323*a* fixed to a structure of an apparatus body 100 and the other end 323*b* fixed to the cutter unit 31.

The other end 323*b* to be fixed to the cutter unit 31 of the protecting member 323 is set to be smaller than the end 323*a* to be fixed to the structure of the apparatus body 1 in such a manner that the other end 3236 can pass through an inner part of the end 323*a* in drawing.

When the cutter unit 31 is drawn out, consequently, the protecting member 323 is extended or contracted depending on a drawing amount (a width) so that the lower blade 314 is always protected.

Figure 18A:
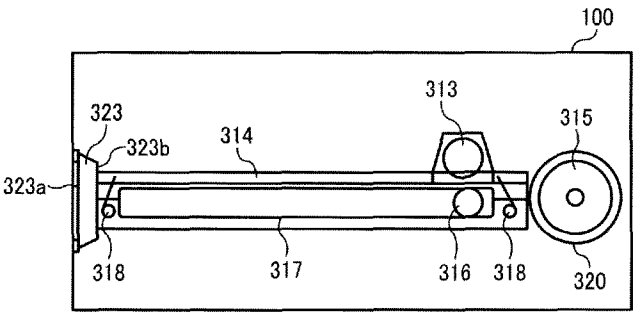
FIGS. 18A and 18B are views for explaining a cutter unit seen in a conveyance direction which are to be used for description of a sixth exemplary embodiment of the present disclosure.
Figure 18B:
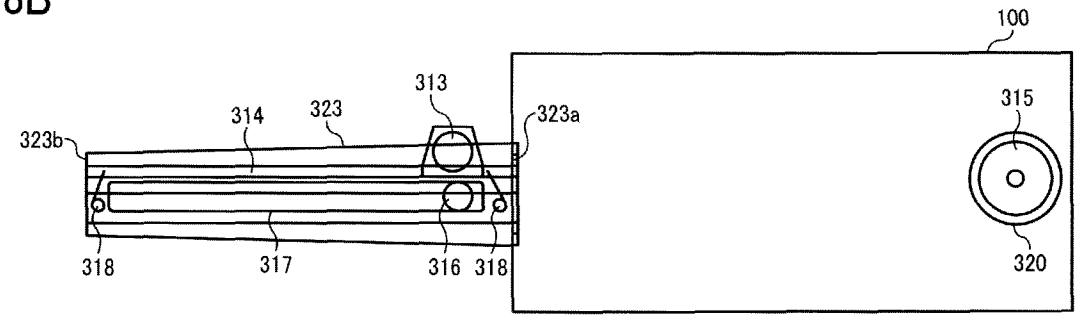

Next, a sixth exemplary embodiment of the present disclosure is described with reference to FIGS. 18A and 18B. FIGS. 18A and 18B are views for explaining a cutter unit seen in a conveyance direction which are to be used for description of the exemplary embodiment, and FIG. 18A illustrates a state in which the cutter unit is accommodated in an apparatus body and FIG. 18B illustrates a state in which the cutter unit is drawn from the apparatus body.

In the sixth exemplary embodiment, a motor 315 of a cutter unit 31 is fixed to an apparatus body 100 side and the cutter unit 31 divides and pulls out a portion other than the motor 315. The motor 315 to be left in the apparatus body 100 is protected by the protecting member 320.

When the cutter unit 31 is drawn out, consequently, a lower blade 314 to be drawn out is protected so that a user can be prevented from coming in contact with the lower blade 314.

Figure 19A:
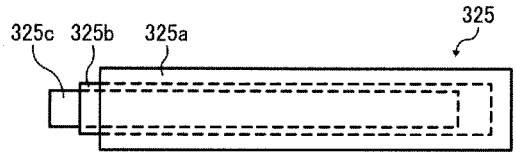
FIGS. 19A and 19B are views for explaining a protecting member which are to be used for description of a seventh exemplary embodiment of the present disclosure.
Figure 19B:
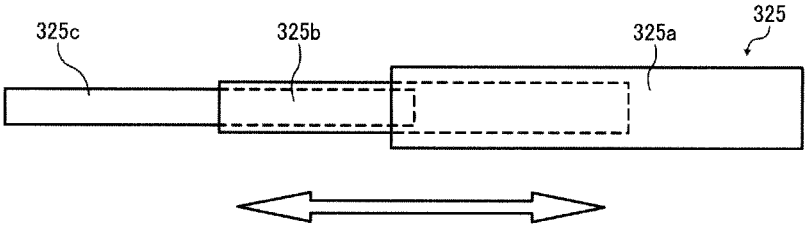

Next, a seventh exemplary embodiment of the present disclosure is described with reference to FIGS. 19A and 19B. FIGS. 19A and 19B are views for explaining a protecting member which are to be used for description of the exemplary embodiment, and FIG. 19A illustrates a contraction state and FIG. 19B illustrates an extension state.

A protecting member 325 of the present embodiment is constituted by first to third members 325*a*, 325*b* and 325*c* having rigidity (at least two members are preferable. Three members are used in this example). The second member 325*b* can be taken in/out of the first member 325*a* and the third member 325*c* can be taken in/out of the second member 325*b* so that the whole protecting member 325 can be extended or contracted.

With the structure, the protecting member 325 is extended or contracted depending on a drawing width (amount) of the cutter unit so that the cutter unit can be protected. By increasing a size of a component constituting the protecting member, moreover, it is also possible to decrease the number of the components.

Figure 20A:
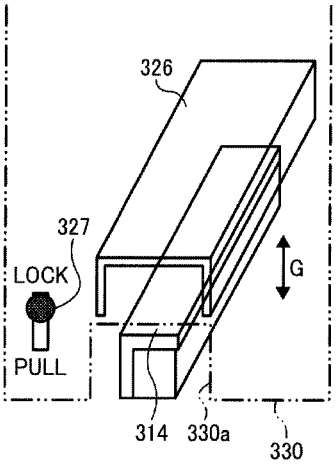
FIGS. 20A and 20B are explanatory perspective views which are to be used for description of an eighth exemplary embodiment of the present disclosure.
Figure 20B:
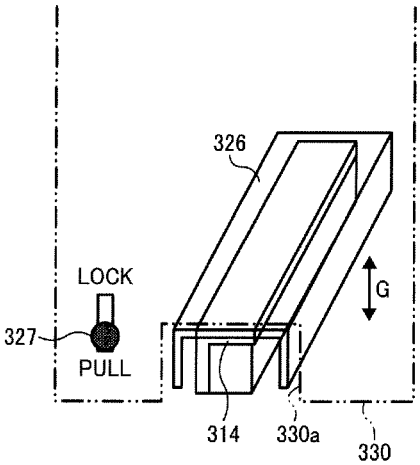

Next, an eighth exemplary embodiment of the present disclosure is described with reference to FIGS. 20A and 20B. FIGS. 20A and 20B are explanatory perspective views which are to be used for description of the exemplary embodiment, and FIG. 20A illustrates a locking state and FIG. 20B illustrates an unlocking state. A protecting member is shown in a transmission state.

In the present embodiment, a protecting member 326 for protecting a lower blade 314 of a cutter unit 31 is movable in a direction of an arrow G between a protecting position (an unlocking position) in which the lower blade 314 is protected and a retracting position (a locking position) in which retraction from the lower blade 314 is carried out to enable print (a print medium 2 can pass therethrough).

There is provided a switch (a lever or the like) 327 for changing over a locking position (LOCK) in which a sheet feed conveyance unit 106 cannot be drawn out and an unlocking position (PULL) in which the drawing is enabled, and the protecting member 326 is moved between the protecting position and the retracting position interlockingly with an operation of the switch 327.

On the other hand, a stopper member 330 is provided on an apparatus body 100 side. The stopper member 300 has an opening member 330*a* for permitting passage of the cutter unit 31 when the protecting member 326 is placed in the protecting position and interfering with the protecting member 326 to regulate the passage of the cutter unit 31 when the protecting member 326 is placed in the retracting position.

With the structure, when the switch 327 is set into the locking position, the protecting member 326 is placed in the retracting position (the locking position) as shown in FIG. 20A. Therefore, it is impossible to pull out the sheet feed conveyance unit including the cutter unit 31. Accordingly, the cutter unit 31 is drawn out without the lower blade 314 of the cutter unit 31 protected. Consequently, the user can be prevented from coming in contact with the lower blade 314.

When the switch 327 is set into the unlocking position, moreover, the protecting member 326 is moved to the protecting position (the unlocking position) as shown in FIG. 20B. Even if the sheet feed conveyance unit 106 including the cutter unit 31 is drawn out, therefore, the lower blade 314 of the cutter unit 31 is protected by the protecting member 326. Accordingly, the user can be prevented from coming in contact with the lower blade 314.

The movement of the protecting member 326 from the protecting position to the retracting position can also be automatically carried out by using a driving unit through detection that the sheet feed conveyance unit is attached to an apparatus body, for example.

Figure 21:
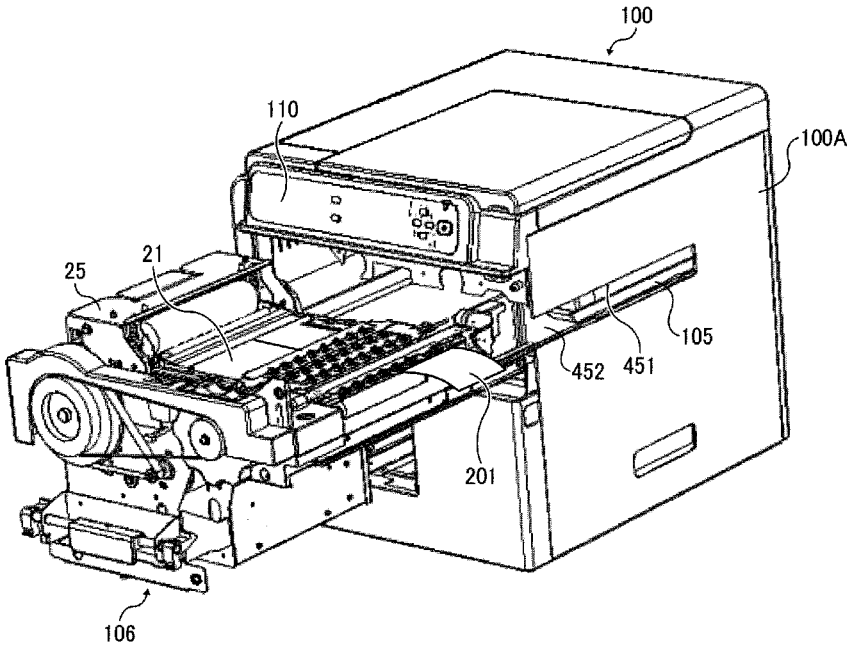
FIG. 21 is a perspective view for explaining a state in which a sheet feed conveyance unit is drawn out of an apparatus body which is to be used for description of a ninth exemplary embodiment of the present disclosure.

Next, a ninth exemplary embodiment of the present disclosure is described with reference to FIG. 21. FIG. 21 is a perspective view for explaining a state in which a sheet feed conveyance unit is drawn from an apparatus body which is to be used for description of the exemplary embodiment. The front cover shown in FIG. 6 or the like is omitted.

In the present embodiment, a drawing direction of a sheet feed conveyance unit 106 is set to be an orthogonal direction to a print medium conveyance direction.

A notch 451 is formed on an outer side face 100A provided with an output port 105 of an apparatus body 100 in the drawing direction of the sheet feed conveyance unit 106.

A space 452 is formed on an inside of the notch 451 in the apparatus body 100 in such a manner that a print medium 2 or a print medium piece 200 does not interfere with any member even if the print medium 2 is present from an output conveyer 104 to the output port 105 when the sheet feed conveyance unit 106 is to be drawn out. A member with which the print medium 2 or the print medium piece 200 interferes is a structure frame or the like, for example.

Figure 22:
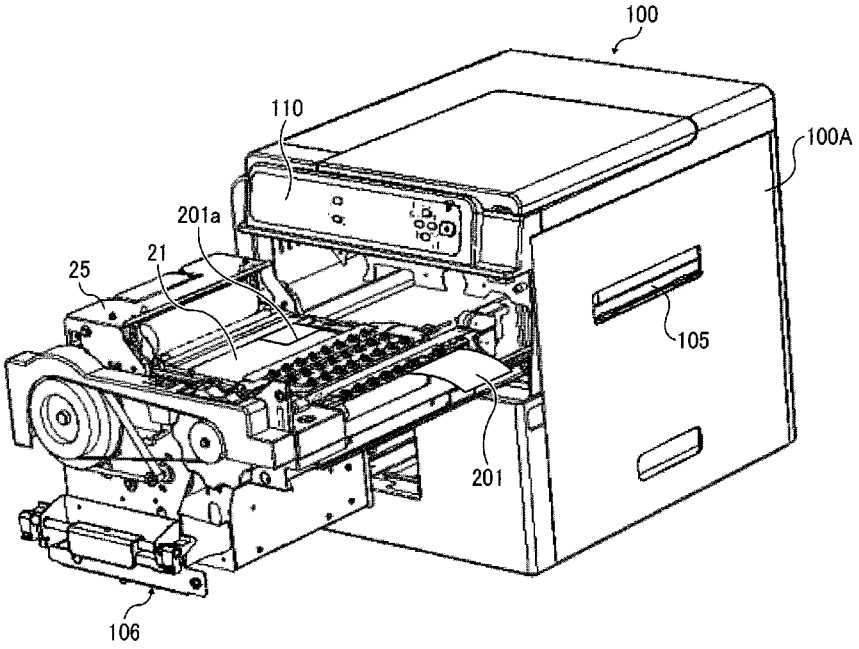
FIG. 22 is a perspective view for explaining a state in which a sheet feed conveyance unit is drawn from an apparatus body according to a comparative example which is to be used for description of action according to the exemplary embodiment.

The function of the present embodiment having the structure is described with reference to FIG. 22 illustrating a comparative example.

When the sheet feed conveyance unit 106 is to be drawn from the apparatus body 100 to load a roll body 4 onto a sheet feeder 101 and to then set the print medium 2 as described above, it is necessary to set the print medium 2 in parallel with a conveyance direction. If the print medium 2 is placed obliquely with respect to the conveyance direction, an image and a cutting direction are curved.

In order to set the print medium 2 in parallel with the conveyance direction, it is preferable to pull out a leading end of the print medium 2 as greatly as possible. For example, as shown in FIG. 21, a leading end 201 of the print medium 2 is pulled out to a downstream side or the output port 105 from a nipping portion (an outlet of the output conveyer 104) between an output roller 32 and a spur roller 33.

On the other hand, in the case in which the leading end of the print medium 2 is stopped on a protection belt 21 (for example, a position indicated as a leading end 201*a* in FIG. 22), the oblique setting of the print medium 2 is noticed with difficulty if any.

Accordingly, the print medium 2 can be preferably set to the sheet feed conveyance unit 106 drawn out, and pushed and loaded into the apparatus body 100 in a state in which the leading end 201 of the print medium 2 is drawn out toward the downstream side from the nipping portion between the output roller 32 and the spur roller 33.

In the case in which the output port 105 is an enclosed opening as in the comparative example shown in FIG. 22, however, the print medium 2 interferes with the periphery of the output port 105 and is thus broken when the sheet feed conveyance unit 106 is inserted and drawn.

Even if the notch 451 linked to the output port 105 is provided as in the present embodiment, moreover, the print medium 2 interferes with the structure frame and is thus broken in the same manner if the structure frame or the like is present between the sheet feed conveyance unit 106 and the notch 451.

Also in the case in which a jam occurs in the middle of the print so that the leading end 201 of the print medium 2 is fed to the output port 105 and is stopped in this state, similarly, there is a fear that the print medium 2 might be broken and left in an inner part with the structure according to the comparative example when the sheet feed conveyance unit 106 is drawn out.

In the present embodiment, therefore, the notch 451 is formed on the side face 100A provided with the output port 105 in the drawing direction of the sheet feed conveyance unit 106, and the space 452 is formed on the inside of the notch 451. The space 452 has no member with which the print medium 2 or the print medium piece 200 interferes when the sheet feed conveyance unit 106 is drawn out.

Consequently, the sheet feed conveyance unit 106 is drawn out and the leading end 201 of the print medium 2 is pulled out to the downstream side of an outlet of the output conveyer 104 or the output port 105, and the sheet feed conveyance unit 106 can be pushed and loaded into the apparatus body 100 in this state.

Accordingly, the print medium 2 can easily be set in parallel with the conveyance direction so that a stable conveyance property can be obtained, and furthermore, workability of the work for setting the print medium 2 can be enhanced.

When the jam occurs in the middle of the print, moreover, it is possible to pull out the sheet feed conveyance unit 106 without breaking the print medium 2 also in the case in which the leading end 201 of the print medium 2 is present on the downstream side of the outlet of the output conveyer 104 or across the output port 105.

Accordingly, it is possible to prevent the print medium 2 or the print medium piece 200 from being broken and left in the apparatus body 100 in the drawing of the sheet feed conveyance unit 106 up to the downstream side of the nipping portion between the output roller 32 and the spur roller 33 or the output port 105. Thus, it is possible to easily carry out a jam removing work.

Figure 23:
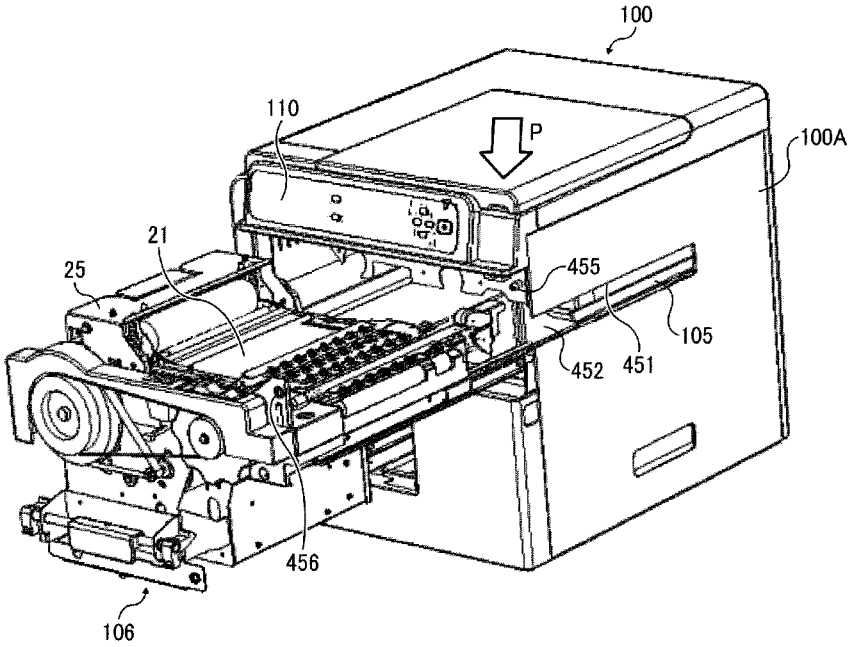
FIG. 23 is a perspective view for explaining a state in which a sheet feed conveyance unit is drawn from an apparatus body which is to be used for description of a tenth exemplary embodiment of the present disclosure.

Next, a tenth exemplary embodiment of the present disclosure is described with reference to FIG. 23. FIG. 23 is a perspective view for explaining a state in which a sheet feed conveyance unit is drawn from an apparatus body which is to be used for description of the exemplary embodiment.

In the present embodiment, with the structure according to the ninth exemplary embodiment, a pin 455 protruded in a drawing direction of a sheet feed conveyance unit 106 is formed on an apparatus body 100 side, and a hole 456 for fitting the pin 455 therein is formed on a sheet feed conveyance unit 106 side. A relationship between the pin 455 and the hole 456 may be reversed.

With the structure, when the sheet feed conveyance unit 106 is loaded into the apparatus body 100, the pin 455 is fitted in the hole 456. Consequently, it is possible to increase an outer strength of the apparatus body 100 with respect to a load in a downward direction from above.

In other words, in the case in which a notch 451 is formed on an outer side face 100A as in the ninth exemplary embodiment, the outer strength of the apparatus body 100 is reduced with respect to a load P in a downward direction from above in a portion in which the notch 451 is formed. Therefore, the pin 455 in an orthogonal direction to the load P in the downward direction from above is fitted in the hole 456 to increase the strength.

Figure 24:
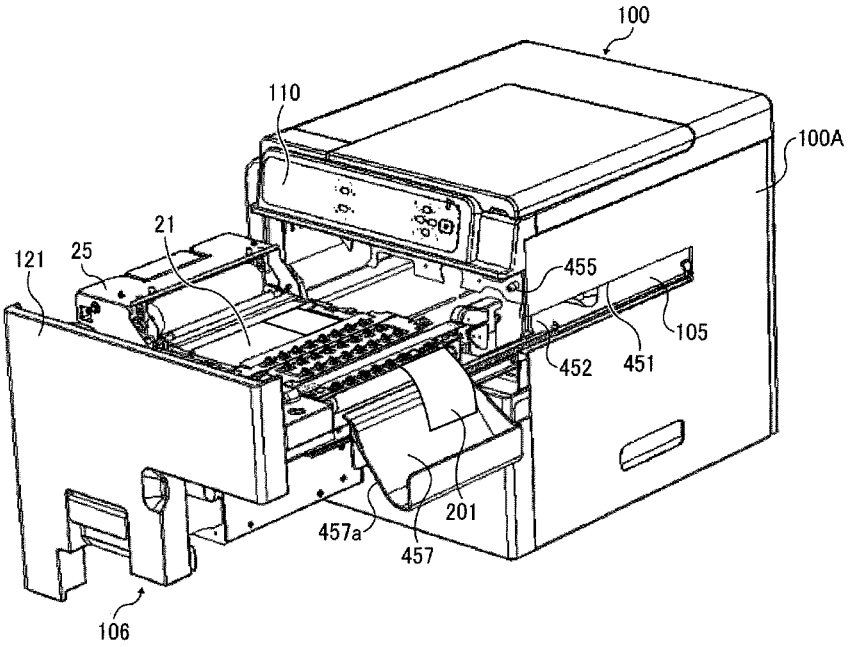
FIG. 24 is a perspective view for explaining a state in which a sheet feed conveyance unit is drawn from an apparatus body which is to be used for description of an eleventh exemplary embodiment of the present disclosure.

Next, an eleventh exemplary embodiment of the present disclosure is described with reference to FIG. 24. FIG. 24 is a perspective view for explaining a state in which a sheet feed conveyance unit is drawn from an apparatus body which is to be used for description of the exemplary embodiment.

In the exemplary embodiment, an output tray 457 is provided integrally with a sheet feed conveyance unit 106. The output tray 457 serves to receive a print medium 2 or a print medium piece 200 fed from an output conveyer 104.

Also in the case in which the print medium 2 or the print medium piece 200 goes out of the output conveyer 104, consequently, it does not collide with an end 457*a* of the output tray 457.

In other words, in some cases in which the output tray 457 is fixed just under an output port 105 of a side face 100A, the print medium 2 or the print medium piece 200 in the vicinity of the output conveyer 104 does not interfere with the side face 100A or a structure frame because of a notch 451 and a space 452 in an operation for loading the sheet feed conveyance unit 106 but a leading end of the print medium 2 or the print medium piece 200 taken out and hung down to be long from the output conveyer 104 may interfere with the fixed output tray 457 and may thus be broken.

On the other hand, the output tray 457 is provided integrally with the sheet feed conveyance unit 106. Also in the loading or drawing of the sheet feed conveyance unit 106, therefore, the print medium 2 or the print medium piece 200 taken out of the output conveyer 104 is moved together with the output tray 457. For this reason, the print medium 2 or the print medium piece 200 is prevented from colliding with the output tray 457 so as to be broken.

Figure 25A:
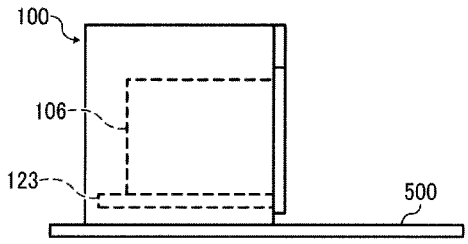
FIGS. 25A to 25C are side views for explaining a twelfth exemplary embodiment of the present disclosure together with action.
Figure 25B:
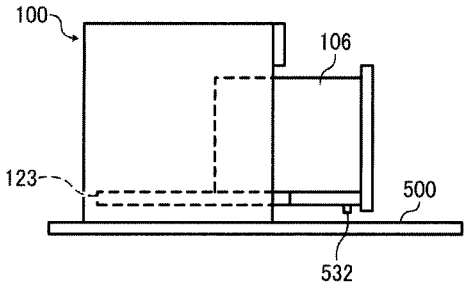
Figure 25C:
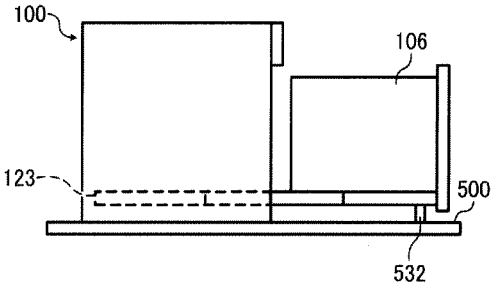

Next, a twelfth exemplary embodiment of the present disclosure is described with reference to FIGS. 25A to 25C. FIGS. 25A to 25C are side views for explaining the exemplary embodiment together with action.

In the exemplary embodiment, a leg 532 is provided in a bottom part of a sheet feed conveyance unit 106. The leg 532 serves to support the sheet feed conveyance unit 106 together with a body installation face 500 when the sheet feed conveyance unit 106 is drawn from an apparatus body 100. The leg 532 is gradually protruded in a downward direction from the bottom part of the sheet feed conveyance unit 106 interlockingly with the drawing of the sheet feed conveyance unit 106, for example.

With the structure, when the sheet feed conveyance unit 106 loaded into the apparatus body 100 as shown in FIG. 25A is drawn from the apparatus body 100 as shown in FIG. 25B, the leg 532 is protruded downward from the bottom part of the sheet feed conveyance unit 106.

As shown in FIG. 25C, the sheet feed conveyance unit 106 is drawn out to a predetermined position so that the leg 532 of the sheet feed conveyance unit 106 is further protruded downward and the sheet feed conveyance unit 106 is thus supported on the body installation face 500 by the leg 532.

Since the sheet feed conveyance unit 106 integrally includes a sheet feeder having a roll body of a print medium 2 and a conveyer having a conveyance belt and a driver thereof, it has a great weight. On the other hand, the apparatus body 100 of which they are drawn out is changed into an almost simple housing, it has a small weight. For this reason, the following case can be supposed. More specifically, a center of gravity is greatly moved in the drawing direction by the drawing operation, and the apparatus body 100 is inclined in the drawing direction. In a bad case, the apparatus is inverted so that the sheet feed conveyance unit 106 collides with the body installation face 500.

By thus providing the leg 532 in the sheet feed conveyance unit 106, however, it is possible to prevent the apparatus body 100 from being tilted or inverted due to inclination of the center of gravity toward the sheet feed conveyance unit 106 side when pulling the sheet feed conveyance unit 106 out of the apparatus body 100.

When the sheet feed conveyance unit 106 is drawn from the apparatus body 100, the leg 532 is not perfectly protruded before the sheet feed conveyance unit 106 is completely drawn out. Therefore, it is possible to prevent interference with the body installation face 500 in the middle of the drawing of the sheet feed conveyance unit 106.

Figure 26A:
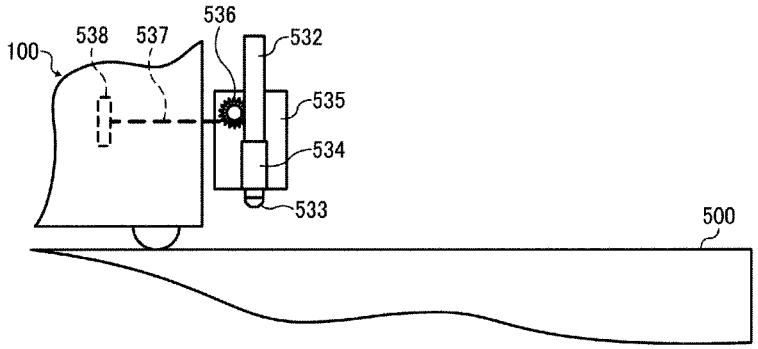
FIGS. 26A and 26B are explanatory side views which are to be used for description of an example of a specific structure according to the twelfth exemplary embodiment.
Figure 26B:
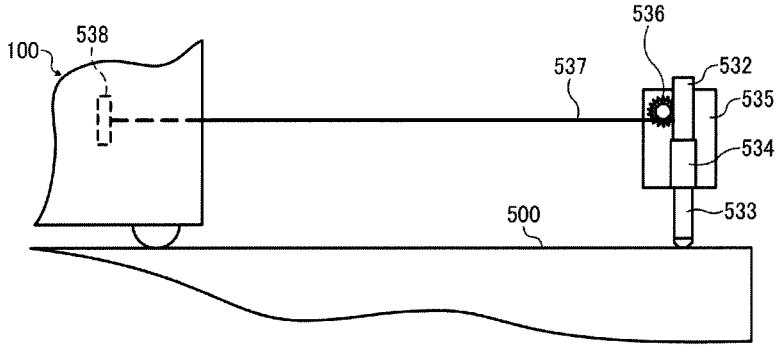
Figure 27:
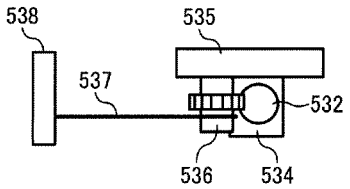
FIG. 27 is an explanatory plan view illustrating the same.

Next, an example of a specific structure according to the twelfth exemplary embodiment is described with reference to FIGS. 26A to 27. FIGS. 26A and 26B are explanatory side views which are to be used for description of the structure and FIG. 27 is an explanatory plan view which is to be used for the description of the structure.

The leg 532 is held to be vertically movable in a leg holder 534, and a tooth (not shown) to be engaged with a gear 536 is formed in an upper part of the leg 532 in a longitudinal direction (a vertical direction). The leg holder 534 and the gear 536 are attached to a fixing member 535 of the sheet feed conveyance unit 106. A rubber member 533 is attached to a lower end of the leg 532 in order to prevent the body installation face 500 from being damaged.

A wire 537 is wound around the gear 536 and the other end of the wire 537 is attached to a fixing member 538 on the apparatus body 100 side. Moreover, rotation force in such a direction as to move the leg 532 in an upward direction acts on the gear 536 by a spring (not shown) or the like.

With the structure, when the sheet feed conveyance unit 106 is drawn from the apparatus body 100 from a state shown in FIG. 26A to a position shown in FIG. 26B, the gear 536 is rotated by the wire 537 so that the leg 532 is gradually protruded in a downward direction and collides with the body installation face 500.

When the sheet feed conveyance unit 106 is moved in a return direction into the apparatus body 100, then, the gear 536 is rotated in a reverse direction by a spring (not shown) or the like so that the leg 532 is moved in an upward direction and the wire 537 is wound up.

Figure 28A:
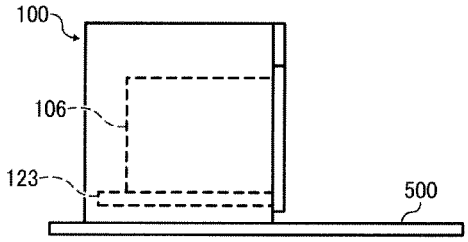
FIGS. 28A to 28C are side views for explaining a thirteenth exemplary embodiment of the present disclosure together with action.
Figure 28B:
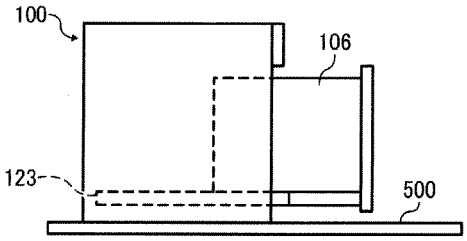
Figure 28C:
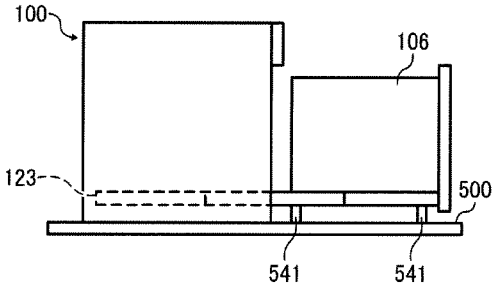

Next, a thirteenth exemplary embodiment of the present disclosure is described with reference to FIGS. 28A to 28C. FIGS. 28A to 28C are side views for explaining the exemplary embodiment together with action.

In the present embodiment, a bottom part of a sheet feed conveyance unit 106 has legs 541 and 541. The legs 541 and 541 are protruded from the bottom part of the sheet feed conveyance unit 106 when the sheet feed conveyance unit 106 is to be drawn from an apparatus body 100, and support the sheet feed conveyance unit 106 together with a body installation face 500. The leg 541 appears in a downward direction with a rotation from the bottom part of the sheet feed conveyance unit 106 interlockingly with the drawing of the sheet feed conveyance unit 106, for example.

With the structure, when the sheet feed conveyance unit 106 loaded into the apparatus body 100 as shown in FIG. 28A is drawn from the apparatus body 100 as shown in FIG. 28B, the legs 541 and 541 appear with a rotation from the bottom part of the sheet feed conveyance unit 106.

When the sheet feed conveyance unit 106 is drawn out to a predetermined position as shown in FIG. 28C, the leg 541 rotates to a position in which the sheet feed conveyance unit 106 is supported on the body installation face 500 so that the sheet feed conveyance unit 106 is supported on the body installation face 500.

Consequently, it is possible to prevent the apparatus body 100 from being tilted due to inclination of a center of gravity toward the sheet feed conveyance unit 106 side when the sheet feed conveyance unit 106 is drawn from the apparatus body 100. Moreover, it is possible to prevent the leg 541 from interfering with the body installation face 500 when the sheet feed conveyance unit 106 is drawn out.

Figure 29A:
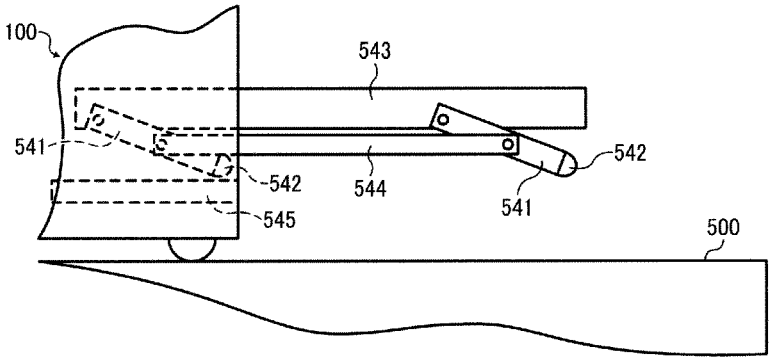
FIGS. 29A and 29B are side views of a portion of an image forming apparatus according to the thirteenth exemplary embodiment.
Figure 29B:
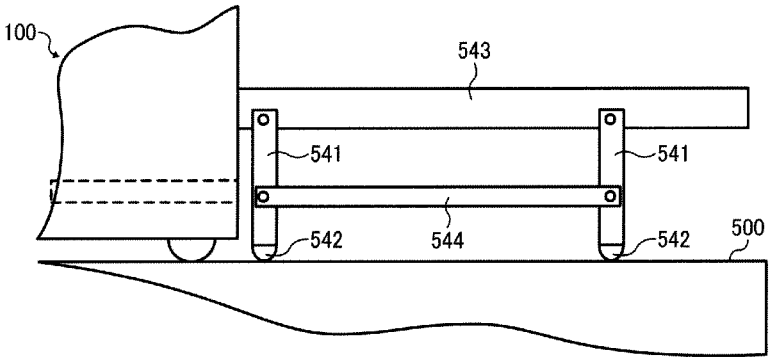

Next, an example of a structure according to the thirteenth exemplary embodiment is described with reference to FIGS. 29A and 29B. FIGS. 29A and 29B are side views of a portion of an image forming apparatus according to the thirteenth exemplary embodiment.

The two legs 541 are rotatably supported on a fixing member 543 of the sheet feed conveyance unit 106 and are connected by a link 544 in a lower part than a place where they are supported. When the sheet feed conveyance unit 106 is not perfectly drawn out, the two legs 541 are put on a rail 545 in the apparatus body 100 and are thus folded up by the link 544. A rubber member 542 is attached to lower parts of the two legs 541 in order to prevent the body installation face 500 from being damaged.

With the structure, when the sheet feed conveyance unit 106 is drawn from the apparatus body 100 from a state shown in FIG. 29A to a position show in FIG. 29B, the leg 541 is rotated and installed onto the body installation face 500.

Figure 30:
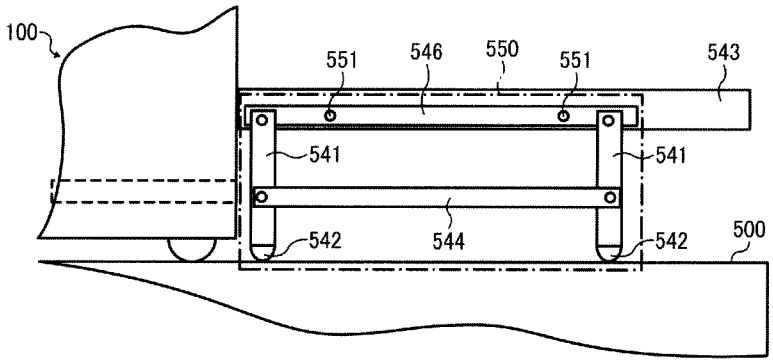
FIG. 30 is a side view of a portion of an image forming apparatus according to a fourteenth exemplary embodiment.

Next, a fourteenth exemplary embodiment of the present disclosure is described with reference to FIG. 30. FIG. 30 is a side view of a portion of the image forming apparatus according to the fourteenth exemplary embodiment.

In the present embodiment, with the specific structure according to the thirteenth exemplary embodiment, the leg 541 and the link 544 are integrated as a leg unit 550 by a holding member 546. In the leg unit 550, the holding member 546 is removably provided on a fixing member 543 of the sheet feed conveyance unit 106 with a screw 551.

Consequently, the leg unit 550 can be treated as an option and attachment positions to the fixing member 543 are provided in different heights. Thus, it is possible to vary the height of the leg unit 550.

Figure 31A:
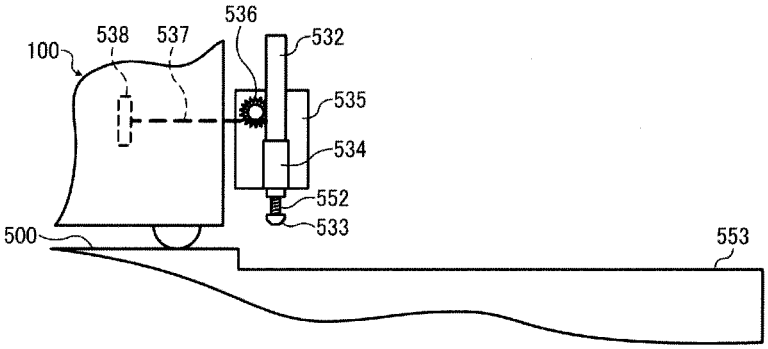
FIGS. 31A and 31B are side views of a portion of an image forming apparatus according to a fifteenth exemplary embodiment of the present disclosure.
Figure 31B:
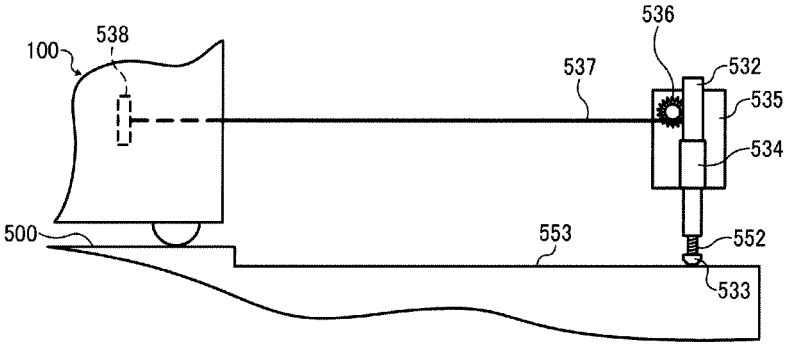

Next, a fifteenth exemplary embodiment of the present disclosure is described with reference to FIGS. 31A and 31B. FIGS. 31A and 31B are side views of a portion of an image forming apparatus according to the fifteenth exemplary embodiment.

In the present embodiment, with the specific structure according to the twelfth exemplary embodiment, the rubber member 533 of the leg 532 is extendably provided on the leg 532 with a screw 552.

Consequently, a length of the whole leg 532 can be increased or reduced. Even if a step is provided between the body installation face 500 and a face 553 to which the sheet feed conveyance unit 106 is opposed in a drawing position, therefore, it is possible to reliably dispose the leg 532.

Figure 32:
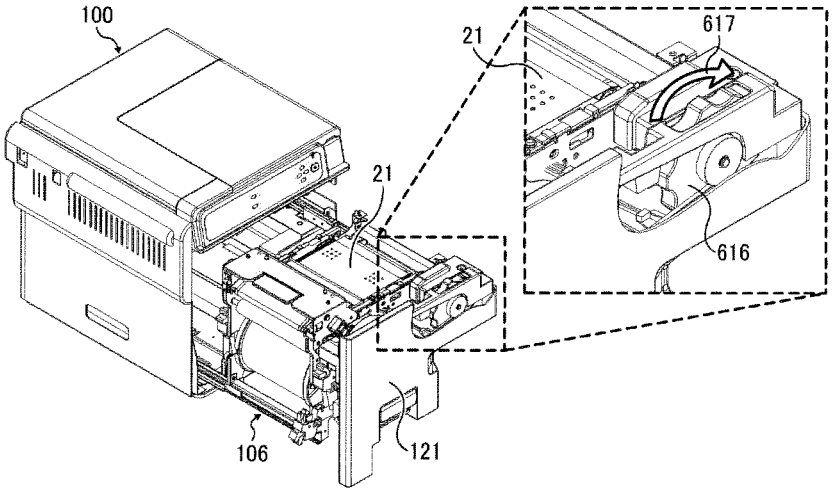
FIG. 32 is a perspective view for explaining a state in which a sheet feed conveyance unit is drawn from an apparatus body which is to be used for description of a sixteenth exemplary embodiment of the present disclosure.

Next, a sixteenth exemplary embodiment of the present disclosure is described with reference to FIG. 32. FIG. 32 is a perspective view for explaining a state in which a sheet feed conveyance unit is drawn from an apparatus body which is to be used for description of the exemplary embodiment.

In the present embodiment, there is provided a rotatable operation dial 616 to be an operation unit for rotating a protection belt 21 in a state in which a sheet feed conveyance unit 106 is drawn out.

When a print medium 2 is to be set onto the protection belt 21, consequently, a user manually rotates the operation dial 616 in a direction of an arrow 617 or a reverse direction thereto in execution of jam processing so that the protection belt 21 is moved in a medium feeding direction or a reverse direction to the medium feeding direction.

When the jam processing is to be executed, a guide unit 107 (a guide member 25) is brought into an opening position depending on a jam position.

Thus, the jam processing can be carried out. Therefore, it is possible to easily remove the print medium 2 with occurrence of a jam. By the rotation of the protection belt 21 through the operation dial 616, moreover, a user can be prevented from touching a front face of the protection belt 21 which is carelessly subjected to a non-adhesive treatment, resulting in damage of the non-adhesive function.

In other words, in the image forming apparatus according to the present embodiment, if a print medium having an active adhesive layer is used in a roll state, the adhesive layer tends to adhere to surrounding members when the print medium is set or in the jam processing.

For this reason, it is hard to carry out the operation for setting a print medium into a predetermined position. In the case in which the adhesive layer adheres to the surrounding members, it should be once peeled and set again. If a hand is put in the apparatus in the jam processing, moreover, there is a fear that a surrounding important functional component, for example, a recording head of an image forming unit or the like might be touched by mistake and thus broken when the adhesive print medium is peeled. In order to convey the adhesive print medium, furthermore, it is preferable to execute a non-adhesive treatment over a front face of a roller or a belt related to conveyance in an inner part. If they are touched by a human hand, however, non-adhesiveness is damaged by an oil-stained hand or the like. Thus, stable conveyance cannot be carried out.

By providing an operation unit for moving a protection belt, therefore, it is possible to move the print medium without touching the roller or the belt which is subjected to the non-adhesive treatment when setting the print medium. Thus, it is possible to easily position the print medium.

When the jam processing is to be carried out, moreover, it is possible to feed or return the print medium or the protection belt by the operation unit. Therefore, it is possible to enhance workability of the jam processing.

Figure 33:
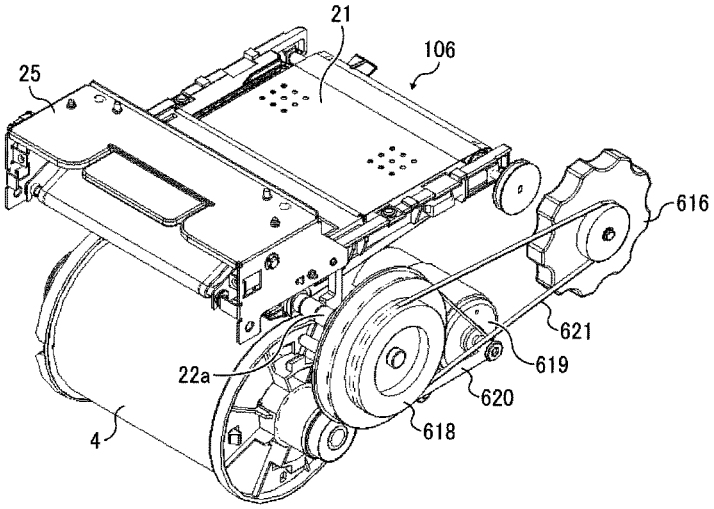
FIG. 33 is a perspective view for explaining the sheet feed conveyance unit which is to be used for describing the details of a driving transmission assembly of a protection belt through an operation dial according to the sixteenth exemplary embodiment.
Figure 34:
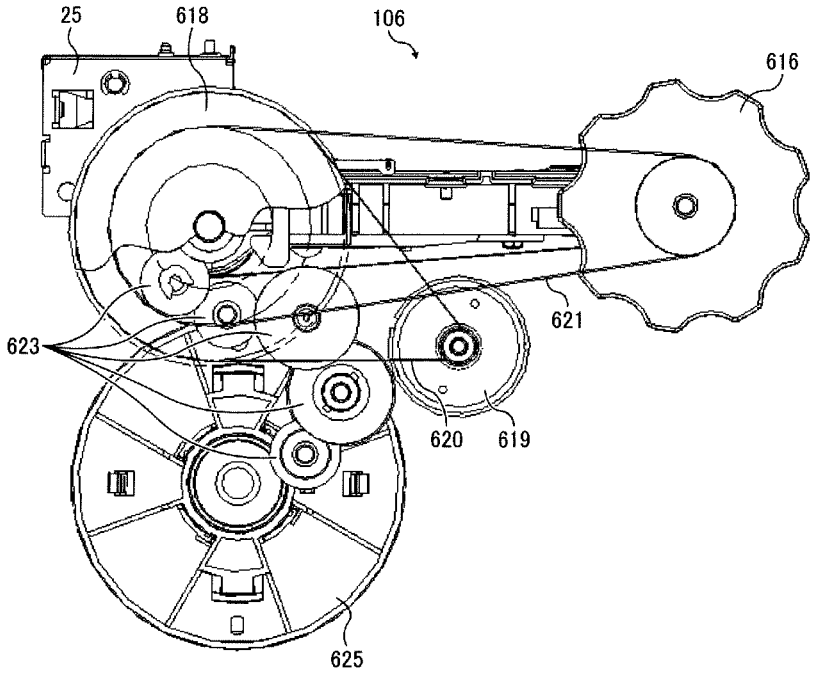
FIG. 34 is a side view for explaining the same.

Next, the details of a driving transmission assembly for the protection belt through the operation dial according to the present embodiment is described with reference to FIGS. 33 and 34. FIG. 33 is a perspective view for explaining a sheet feed conveyance unit which is to be used for the description, and FIG. 34 is an explanatory side view.

A driving pulley 618 is fixed to a roller shaft 22*a* of a conveyance roller 22. A timing belt 620 is laid between the driving pulley 618 and a driving motor 619. Moreover, a timing belt 621 is laid between the driving pulley 618 and an operation dial 616.

Moreover, a rotation is transmitted from the driving pulley 618 to a spool member 625 for attaching a roll body 4 through a driving gear train 623.

With the structure, the operation dial 616 is manually rotated in a state in which the driving motor 619 is stopped. Consequently, it is possible to synchronously rotate and operate a protection belt 21 and the roll body 4 through each driving transmission passage.

Consequently, a print medium 2 is neither stretched nor loosened. Accordingly, it is easy to set the print medium 2 or to execute a jam processing work.

Figure 35:
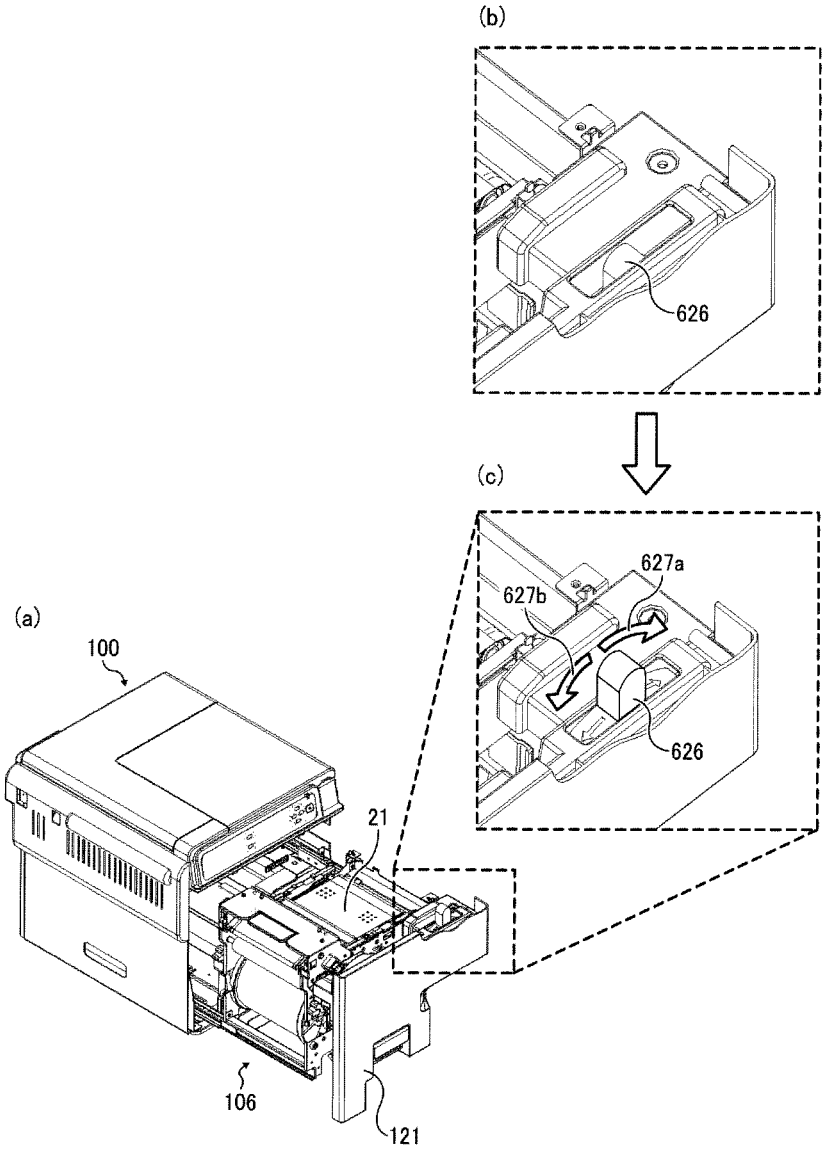
FIG. 35 is a perspective view for explaining a state in which a sheet feed conveyance unit is drawn from an apparatus body which are to be used for description of a seventeenth exemplary embodiment of the present disclosure.

Next, a seventeenth exemplary embodiment of the present disclosure is described with reference to FIG. 35. FIG. 35 includes perspective views (a) to (c) for explaining a state in which a sheet feed conveyance unit is drawn from an apparatus body which are to be used for description of the exemplary embodiment.

In the present embodiment, an operation lever 626 is used in place of the operation dial 616 according to the sixteenth exemplary embodiment.

As shown in FIG. 35(*b*), when a sheet feed conveyance unit 106 is accommodated in an apparatus body 100, the operation lever 626 is stored in the sheet feed conveyance unit 106.

There is employed the structure in which the operation lever 626 is pulled out into an upper operable state as shown in FIG. 35(*c*) when the sheet feed conveyance unit 106 is drawn out.

Moreover, there is provided a detecting unit (a sensor or a switch) for detecting that the operation lever 626 is brought down in a direction of an arrow 627*a* or 627*b*. Upon receipt of a result of the detection obtained by the detecting unit, a control unit (not shown) rotates and drives a driving motor 619 in such a manner that a protection belt 21 is moved in a direction in which the operation lever 626 is brought down, for example.

In this case, a moving speed of the protection belt 21 is set to be low, for example, approximately several tens millimeters per second.

Also in the case in which a load of the sheet feed conveyance unit 106 is great, consequently it is possible to reduce a load of a user in a feeding operation in drawing. Consequently, usability can be enhanced.

Figure 36:
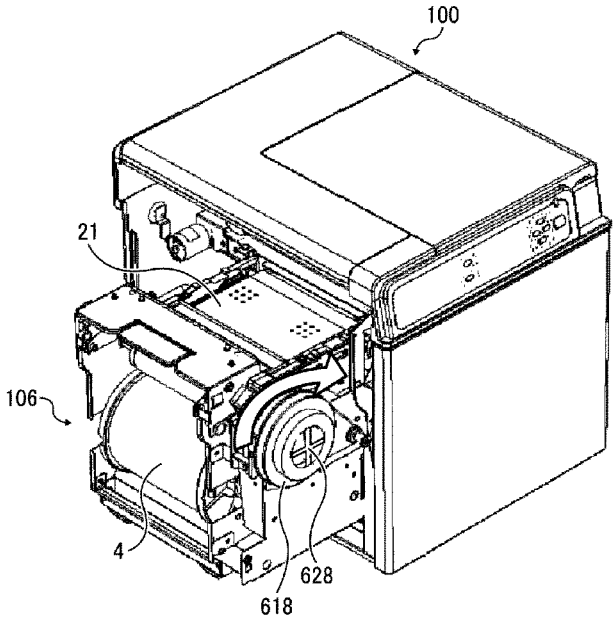
FIG. 36 is a perspective view for explaining a state in which a sheet feed conveyance unit is drawn from an apparatus body which is to be used for description of an eighteenth exemplary embodiment of the present disclosure.

Next, an eighteenth exemplary embodiment of the present disclosure is described with reference to FIG. 36. FIG. 36 is a perspective view for explaining a state in which a sheet feed conveyance unit is drawn from an apparatus body which is to be used for description of the exemplary embodiment.

In the present embodiment, a drawing direction of a sheet feed conveyance unit 106 is set to be a direction turned toward an upstream side in a conveyance direction in the same manner as in the second exemplary embodiment (FIG. 9). In this case, even if a print medium 2 or a print medium piece 200 remains in an output port 105, it is drawn out in the conveyance direction. Even if the sheet feed conveyance unit 106 is drawn out due to jam processing, therefore, the print medium 2 or the print medium piece 200 is prevented from being broken.

A driving pulley 618 is provided with a cross-shaped knob 628 which serves as an operation unit for rotationally moving a protection belt 21. A user catches the cross-shaped knob 628 with a finger to carry out a rotation in a direction of an arrow or a reverse direction. Consequently, the protection belt 21 can be operated in an advancing direction or a reverse direction.

Consequently, it is easy to execute a work for setting a print medium or a jam processing work.

Although there is employed the structure in which the linerless label sheet is used as the print medium 2 in the exemplary embodiments described above, the present disclosure is not limited thereto. If the print medium 2 (a roll sheet or the like) is supplied through a roll body, generally, the sheet feeder 101 and the conveyer 103 and output conveyer 104 are integrally united into the sheet feed conveyance unit 106 and the sheet feed conveyance unit 106 can be drawn from the apparatus body 100. Consequently, it is possible to considerably enhance the setting property of the print medium 2 to the apparatus.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an apparatus body, a sheet feeder to load a roll body including a recording medium wound around the roll body;

an image forming unit to form an image on the recording medium, the recording medium being a linerless label sheet having an adhesive face with no release sheet on the adhesive face; and a conveyance unit including a conveyance roller, a driven roller, an opposed roller disposed opposite to the conveyance roller, and a conveyance belt disposed opposing the image forming unit to convey the recording medium drawn out from the roll body with the recording medium opposing the image forming unit, the conveyance belt being wound around the conveyance roller and the driven roller and being circularly moveable by the conveyance roller, wherein the opposed roller and the conveyance roller sandwich the conveyance belt and the recording medium together, wherein the image forming unit remains in the apparatus body and is not drawable from the apparatus body, and wherein the sheet feeder and the conveyance unit including the conveyance belt are integrated as a sheet feed conveyance unit, and the sheet feed conveyance unit is configured and disposed to be drawable from the apparatus body to at least a position at which the roll body is loadable in the sheet feeder and the conveyance belt is visible.

2. The image forming apparatus according to claim 1, further comprising:

a cutting unit to cut the recording medium having the image formed by the image forming unit, into a recording medium piece; and an output conveyance unit to output the recording medium piece, wherein the sheet feeder, the conveyance unit, and the output conveyance unit are integrated as the sheet feed conveyance unit.

3. The image forming apparatus according to claim 2, wherein the cutting unit comprises an upper blade movable to cut the recording medium, a lower blade to receive the recording medium, a driving motor to move the upper blade, and a protecting member to protect the driving motor of the cutting unit when the sheet feed conveyance unit is drawn from the apparatus body.

4. The image forming apparatus according to claim 3, wherein the protecting member is configured to expand and contract in response to drawing of the sheet feed conveyance unit.

5. The image forming apparatus according to claim 3, wherein the protecting member is movable between a protecting position at which the sheet feed conveyance unit is drawable and a retracting position at which the sheet feed conveyance unit is not drawable.

6. The image forming apparatus according to claim 2, wherein the cutting unit comprises an upper blade movable to cut the recording medium, a lower blade to receive the recording medium, a driving motor to move the upper blade, and a protecting member to protect the lower blade of the cutting unit when the sheet feed conveyance unit is drawn from the apparatus body.

7. The image forming apparatus according to claim 2, wherein the cutting unit comprises an upper blade movable to cut the recording medium, a lower blade to receive the recording medium, and a driving motor to move the upper blade, and the driving motor is configured to be separated from the cutting unit and remain in the apparatus body when the sheet feed conveyance unit is drawn from the apparatus body.

8. The image forming apparatus according to claim 1, wherein the conveyance unit is configured to convey the recording medium with the adhesive face of the recording medium releasably attached on the conveyance belt.

9. The image forming apparatus according to claim 1, wherein the sheet feeder is disposed below the conveyance belt of the conveyance unit.

10. The image forming apparatus according to claim 1, wherein, with the sheet feed conveyance unit drawn from the apparatus body, the roll body is loadable into the sheet feeder from a conveyance direction in which the conveyance unit conveys the recording medium, and the sheet feed conveyance unit is drawable from the apparatus body in a direction perpendicular to the conveyance direction.

11. The image forming apparatus according to claim 1, wherein, with the sheet feed conveyance unit drawn from the apparatus body, the roll body is loadable into the sheet feeder from a conveyance direction in which the conveyance unit conveys the recording medium, and the sheet feed conveyance unit is drawable from the apparatus body in a direction along the conveyance direction.

12. An image forming apparatus, comprising:

an apparatus body, a sheet feeder to load a roll body including a recording medium wound around;

an image forming unit to form an image on the recording medium; and a conveyance unit including a conveyance belt to convey the recording medium drawn out from the roll body so as to oppose the recording medium to the image forming unit, wherein the sheet feeder and the conveyance unit are integrated as a sheet feed conveyance unit, and the sheet feed conveyance unit is configured to load the roll body in at least the sheet feeder and be drawable from the apparatus body to a position at which the conveyance belt is visible;

a recording head provided in the image forming unit to eject droplets of a liquid;

a liquid cartridge replaceably disposed to supply the liquid to the recording head; and a waste liquid tank to accommodate a waste liquid generated by a maintenance operation for maintaining and recovering a performance of the recording head, wherein at least one of the liquid cartridge and the waste liquid tank is drawable in same direction as a direction in the sheet feed conveyance unit is drawable from the apparatus body.

13. The image forming apparatus according to claim 12, wherein the sheet feed conveyance unit comprises an outer cover at a front face side thereof in the direction in which the sheet feed conveyance unit is drawable from the apparatus body, and the outer cover has a sub cover openably and closably provided to cover a front face of the at least one of the liquid cartridge and the waste liquid tank.

14. The image forming apparatus according to claim 1, wherein the apparatus body has, as a front face, a face at which a control panel is disposed, and the sheet feed conveyance unit is insertable into and drawable from the front face of the apparatus body.

15. The image forming apparatus according to claim 1, wherein the apparatus body comprises an outer surface having an output port to output the recording medium piece, a notch formed at the outer surface and cut in a direction in which the sheet feed conveyance unit is drawn from the apparatus body, and a space at an inner side of the notch relative to the apparatus body, the space having no member to interfere with the recording medium or the recording medium piece present from an exit of the sheet feed conveyance unit to the output port when the sheet feed conveyance unit is drawn from the sheet feed conveyance unit.

16. The image forming apparatus according to claim 1, wherein the sheet feed conveyance unit has a leg to support the sheet feed conveyance unit when the sheet feed conveyance unit is drawn from the apparatus body.

17. The image forming apparatus according to claim 1, wherein the sheet feed conveyance unit has an operation unit to rotate the conveyance belt in a state in which the sheet feed conveyance unit is drawn from the apparatus body.

18. A method of setting a recording medium having an adhesive face with no release sheet adhering on the adhesive face, the method comprising steps of:

drawing a sheet feed conveyance unit from an apparatus body in a direction perpendicular to a conveyance direction in which the recording medium is conveyed by a conveyance unit including a conveyance belt on which the adhesive face of the recording medium is releasably attached, the conveyance unit and a sheet feeder integrated as the sheet feed conveyance unit insertable into and drawable from the apparatus body, the sheet feeder configured to load a roll body including the recording medium wound around;

loading the roll body into the sheet feeder from a direction along the conveyance direction;

drawing the recording medium from the roll body loaded in the sheet feeder; and adhering the adhesive face of the recording medium drawn from the roll body onto the conveyance belt to set the recording medium on the conveyance belt.

* * * * *